US007410298B2

(12) United States Patent
Pawloski

(10) Patent No.: US 7,410,298 B2
(45) Date of Patent: Aug. 12, 2008

(54) CLOSURE DEVICE FOR A RECLOSABLE POUCH

(75) Inventor: James C. Pawloski, Bay City, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 701 days.

(21) Appl. No.: 10/821,341

(22) Filed: Apr. 9, 2004

(65) Prior Publication Data

US 2004/0234172 A1 Nov. 25, 2004

Related U.S. Application Data

(63) Continuation-in-part of application No. 10/440,639, filed on May 19, 2003, now Pat. No. 7,137,736.

(51) Int. Cl.
*B65D 33/16* (2006.01)
*A44B 19/00* (2006.01)

(52) U.S. Cl. ..... 383/61.2; 383/63; 24/585.12

(58) Field of Classification Search ..... 383/63, 383/61.2; 24/585.12
See application file for complete search history.

(56) References Cited

U.S. PATENT DOCUMENTS

| | | | | |
|---|---|---|---|---|
| 475,248 | A | 5/1892 | Pugsley | 301/128 |
| 1,746,565 | A | 2/1930 | Sundback | 24/405 |
| 1,959,318 | A | 5/1934 | Sundback | 24/205 |
| 2,354,485 | A | 7/1944 | Slaughter | 20/0.5 |
| 2,916,197 | A | 12/1959 | Detrie et al. | 229/56 |
| 3,038,225 | A | 6/1962 | Ausnit | 24/201 |
| 3,198,228 | A | 8/1965 | Naito et al. | 150/3 |
| 3,237,844 | A | 3/1966 | Hughes | 229/53 |
| 3,265,789 | A | 8/1966 | Hofer | 264/95 |
| 3,338,284 | A | 8/1967 | Ausnit | 150/3 |
| 3,338,285 | A | 8/1967 | Jaster | 150/3 |

(Continued)

FOREIGN PATENT DOCUMENTS

| | | | |
|---|---|---|---|
| CA | 764647 | 8/1967 | 24/45 |

(Continued)

OTHER PUBLICATIONS

Web page from www.zippak.com "One-Time Locking Zipper".

(Continued)

*Primary Examiner*—Jes F Pascua

(57) ABSTRACT

A reclosable pouch comprises a body portion having first and second bag walls. A first and a second closure mechanism are disposed on internal sides of both the first and second bag walls. The first closure mechanism includes a first female closure element having first and second spaced legs and a first male closure element. The second closure mechanism includes a second female closure element having third and fourth spaced legs and a second male closure element. The first male closure element includes two hook portions extending from an end thereof to engage the legs of the first female closure element and the second male closure element includes only one hook portion extending from an end thereof to engage one of the legs of the second female closure element. The first male closure element disengages from the first female closure element with a first external opening force and the second male closure element disengages from the second female closure element with a second external opening force that is less than the first external opening force.

22 Claims, 12 Drawing Sheets

U.S. PATENT DOCUMENTS

| | | | | | |
|---|---|---|---|---|---|
| 3,340,116 | A | | 9/1967 | Naito | 156/92 |
| 3,347,298 | A | | 10/1967 | Ausnit | 150/3 |
| 3,372,442 | A | | 3/1968 | Ishimatsu | 24/201 |
| 3,410,327 | A | | 11/1968 | Ausnit | 150/3 |
| 3,416,199 | A | | 12/1968 | Imamura | 24/201 |
| 3,416,585 | A | * | 12/1968 | Staller | 383/65 |
| 3,462,332 | A | | 8/1969 | Goto | 156/244 |
| 3,528,600 | A | | 9/1970 | White | 229/54 |
| 3,537,153 | A | | 11/1970 | Ausnit | 24/201 |
| 3,565,147 | A | | 2/1971 | Ausnit | 150/3 |
| 3,565,737 | A | | 2/1971 | Lefevre et al. | 161/36 |
| RE27,174 | E | | 9/1971 | Ausnit | 150/3 |
| 3,608,439 | A | | 9/1971 | Ausnit | 93/35 R |
| 3,715,420 | A | | 2/1973 | Kiyono et al. | 264/171 |
| 3,780,781 | A | | 12/1973 | Uramoto | 150/3 |
| 3,827,472 | A | | 8/1974 | Uramoto | 150/3 |
| 3,840,418 | A | | 10/1974 | Sabee | 156/244 |
| 3,841,816 | A | | 10/1974 | Herz | 425/326 |
| 3,937,395 | A | | 2/1976 | Lawes | 229/62.5 |
| RE28,969 | E | | 9/1976 | Naito | 150/3 |
| 4,046,408 | A | | 9/1977 | Ausnit | 285/188 |
| 4,087,577 | A | | 5/1978 | Hendrickson | 428/110 |
| 4,139,664 | A | | 2/1979 | Wenrick | 428/31 |
| 4,240,604 | A | | 12/1980 | Brach | 248/316 |
| 4,263,079 | A | | 4/1981 | Sutrina et al. | 156/244.11 |
| 4,268,938 | A | | 5/1981 | Walchli | 24/201 |
| 4,279,677 | A | | 7/1981 | Takahashi | 156/160 |
| 4,306,924 | A | | 12/1981 | Kamp | 156/66 |
| 4,315,963 | A | | 2/1982 | Havens | 428/35 |
| 4,354,541 | A | | 10/1982 | Tilman | 150/3 |
| 4,363,345 | A | | 12/1982 | Scheibner | 150/3 |
| 4,372,014 | A | | 2/1983 | Simpson | 24/201 |
| 4,419,159 | A | | 12/1983 | Herrington | 156/66 |
| 4,428,788 | A | | 1/1984 | Kamp | 156/66 |
| 4,484,352 | A | | 11/1984 | Katzin | 383/65 |
| 4,515,647 | A | | 5/1985 | Behr | 156/91 |
| 4,522,678 | A | | 6/1985 | Zieke | 156/501 |
| 4,532,652 | A | | 7/1985 | Herrington | 383/103 |
| 4,555,282 | A | | 11/1985 | Yano | 156/66 |
| 4,561,108 | A | | 12/1985 | Kamp | 383/63 |
| 4,561,109 | A | | 12/1985 | Herrington | 383/65 |
| 4,562,027 | A | | 12/1985 | Behr et al. | 264/146 |
| 4,578,813 | A | | 3/1986 | Ausnit | 383/65 |
| 4,615,045 | A | | 9/1986 | Siegel | 383/5 |
| 4,618,383 | A | | 10/1986 | Herrington | 156/66 |
| 4,655,862 | A | | 4/1987 | Christoff et al. | 156/66 |
| 4,665,557 | A | | 5/1987 | Kamp | 383/63 |
| 4,672,723 | A | | 6/1987 | Hugues et al. | 24/587 |
| 4,673,383 | A | | 6/1987 | Bentsen | 493/381 |
| 4,676,851 | A | | 6/1987 | Scheibner et al. | 156/66 |
| 4,683,015 | A | | 7/1987 | Wagers | 156/66 |
| 4,684,018 | A | | 8/1987 | Jarund | 206/306 |
| 4,698,118 | A | | 10/1987 | Takahashi | 156/499 |
| 4,701,358 | A | | 10/1987 | Behr et al. | 428/35 |
| 4,709,399 | A | | 11/1987 | Sanders | 383/66 |
| 4,710,968 | A | | 12/1987 | Borchardt et al. | 383/63 |
| 4,727,709 | A | | 3/1988 | Zieke et al. | 53/551 |
| 4,736,451 | A | | 4/1988 | Ausnit | 383/65 |
| 4,736,496 | A | | 4/1988 | Fisher et al. | 24/587 |
| 4,741,789 | A | | 5/1988 | Zieke et al. | 156/66 |
| 4,755,248 | A | | 7/1988 | Geiger et al. | 156/244.25 |
| 4,764,977 | A | | 8/1988 | Wagers | 383/63 |
| 4,765,036 | A | | 8/1988 | Iguchi et al. | 24/289 |
| 4,778,282 | A | | 10/1988 | Borchardt et al. | 383/63 |
| 4,787,880 | A | | 11/1988 | Ausnit | 493/213 |
| 4,791,710 | A | | 12/1988 | Nocek et al. | 24/587 |
| 4,792,240 | A | | 12/1988 | Ausnit | 383/63 |
| 4,796,300 | A | | 1/1989 | Branson | 383/63 |
| 4,812,056 | A | | 3/1989 | Zieke | 383/65 |
| 4,812,192 | A | | 3/1989 | Woods et al. | 156/251 |
| 4,822,539 | A | | 4/1989 | Tilman et al. | 264/40.4 |
| 4,829,641 | A | | 5/1989 | Williams | 24/587 |
| 4,832,768 | A | | 5/1989 | Takahashi | 156/66 |
| 4,834,554 | A | | 5/1989 | Stetler, Jr. et al. | 383/100 |
| 4,846,586 | A | | 7/1989 | Bruno | 383/9 |
| 4,854,917 | A | | 8/1989 | Mizukoshi | 464/111 |
| 4,859,259 | A | | 8/1989 | Scheibner | 156/66 |
| 4,869,725 | A | | 9/1989 | Schneider et al. | 604/408 |
| 4,898,492 | A | | 2/1990 | Janowski | 403/340 |
| 4,906,310 | A | | 3/1990 | Broderick et al. | 156/66 |
| 4,907,321 | A | | 3/1990 | Williams | 24/587 |
| 4,929,487 | A | | 5/1990 | Tilman et al. | 428/163 |
| 4,964,739 | A | | 10/1990 | Branson et al. | 383/5 |
| 5,009,828 | A | | 4/1991 | McCree | 264/177.1 |
| 5,012,561 | A | | 5/1991 | Porchia et al. | 24/576 |
| 5,017,021 | A | | 5/1991 | Simonsen et al. | 383/63 |
| 5,022,530 | A | | 6/1991 | Zieke | 206/618 |
| 5,023,122 | A | | 6/1991 | Boeckmann et al. | 428/43 |
| 5,049,223 | A | | 9/1991 | Dais et al. | 156/244.11 |
| 5,053,091 | A | | 10/1991 | Giljam et al. | 156/66 |
| 5,056,933 | A | | 10/1991 | Kamp | 383/63 |
| 5,067,822 | A | | 11/1991 | Wirth et al. | 383/61 |
| 5,070,584 | A | | 12/1991 | Dais et al. | 24/587 |
| 5,092,684 | A | | 3/1992 | Weeks | 383/61 |
| 5,138,750 | A | | 8/1992 | Gundlach et al. | 24/587 |
| 5,140,727 | A | | 8/1992 | Dais et al. | 24/587 |
| 5,141,577 | A | | 8/1992 | Porchia et al. | 156/66 |
| 5,154,086 | A | | 10/1992 | Porchia et al. | 73/818 |
| 5,167,454 | A | | 12/1992 | Woods et al. | 383/35 |
| 5,192,135 | A | | 3/1993 | Woods et al. | 383/63 |
| 5,198,055 | A | | 3/1993 | Wirth et al. | 156/66 |
| 5,209,574 | A | | 5/1993 | Tilman | 383/63 |
| 5,211,481 | A | | 5/1993 | Tilman | 383/63 |
| 5,235,731 | A | | 8/1993 | Anzai et al. | 24/576 |
| 5,238,306 | A | | 8/1993 | Heintz et al. | 383/61 |
| 5,248,201 | A | | 9/1993 | Kettner et al. | 383/63 |
| 5,252,281 | A | | 10/1993 | Kettner et al. | 264/171 |
| 5,259,904 | A | | 11/1993 | Ausnit | 156/244.15 |
| 5,307,552 | A | | 5/1994 | Dais et al. | 29/453 |
| 5,326,176 | A | | 7/1994 | Domke | 383/103 |
| 5,356,222 | A | | 10/1994 | Kettner et al. | 383/63 |
| 5,358,334 | A | | 10/1994 | Simonsen | 383/63 |
| 5,366,294 | A | | 11/1994 | Wirth et al. | 383/61 |
| 5,368,394 | A | | 11/1994 | Scott et al. | 383/63 |
| 5,369,847 | A | | 12/1994 | Naya et al. | 24/30.5 |
| 5,382,094 | A | | 1/1995 | Ausnit | 383/65 |
| 5,384,942 | A | | 1/1995 | Siegel | 24/587 |
| 5,388,910 | A | | 2/1995 | Koyanagi | 383/100 |
| 5,397,182 | A | | 3/1995 | Gaible et al. | 383/63 |
| 5,403,094 | A | | 4/1995 | Tomic | 383/63 |
| 5,405,561 | A | | 4/1995 | Dais et al. | 264/40.1 |
| 5,415,904 | A | | 5/1995 | Takubo et al. | 428/35.2 |
| 5,462,360 | A | | 10/1995 | Tilman et al. | 383/63 |
| 5,472,082 | A | | 12/1995 | Thiele | 206/284 |
| 5,478,228 | A | | 12/1995 | Dais et al. | 425/294 |
| 5,492,705 | A | | 2/1996 | Porchia et al. | 426/106 |
| 5,509,734 | A | | 4/1996 | Ausnit | 383/63 |
| 5,511,884 | A | | 4/1996 | Bruno et al. | 383/63 |
| 5,525,363 | A | | 6/1996 | Herber et al. | 426/130 |
| 5,527,112 | A | | 6/1996 | Dais et al. | 383/211 |
| 5,558,439 | A | | 9/1996 | Tilman | 383/63 |
| 5,564,834 | A | | 10/1996 | Porchia et al. | 383/211 |
| 5,575,747 | A | | 11/1996 | Dais et al. | 493/213 |
| 5,577,305 | A | | 11/1996 | Johnson | 24/587 |
| 5,618,111 | A | | 4/1997 | Porchia et al. | 383/63 |
| 5,647,100 | A | | 7/1997 | Porchia et al. | 24/30.5 |
| 5,660,479 | A | | 8/1997 | May et al. | 383/204 |
| 5,664,299 | A | | 9/1997 | Porchia et al. | 24/400 |
| 5,669,715 | A | | 9/1997 | Dobreski et al. | 383/5 |
| 5,672,009 | A | | 9/1997 | Malin | 383/204 |
| 5,686,126 | A | | 11/1997 | Noel et al. | 426/127 |
| 5,689,866 | A | | 11/1997 | Kasai et al. | 24/587 |
| 5,713,669 | A | | 2/1998 | Thomas et al. | 383/204 |
| 5,718,024 | A | | 2/1998 | Robbins | 24/30.5 R |

| | | | | |
|---|---|---|---|---|
| 5,722,128 | A | 3/1998 | Toney et al. | 24/400 |
| 5,729,876 | A | 3/1998 | Johnson | 24/587 |
| 5,749,658 | A | 5/1998 | Kettner | 383/204 |
| 5,769,772 | A | 6/1998 | Wiley | 493/189 |
| 5,774,954 | A | 7/1998 | Ramsey et al. | 24/587 |
| 5,774,955 | A | 7/1998 | Borchardt et al. | 24/587 |
| 5,775,812 | A | 7/1998 | St. Phillips et al. | 383/5 |
| 5,783,012 | A | 7/1998 | Porchia et al. | 156/66 |
| 5,791,783 | A | 8/1998 | Porchia et al. | 383/211 |
| 5,794,315 | A | 8/1998 | Crabtree et al. | 24/587 |
| 5,804,265 | A | 9/1998 | Saad et al. | 428/35.2 |
| 5,809,621 | A | 9/1998 | McCree et al. | 24/399 |
| 5,817,380 | A | 10/1998 | Tanaka | 428/35.7 |
| 5,827,163 | A | 10/1998 | Kettner | 493/211 |
| 5,832,145 | A | 11/1998 | Dais et al. | 383/211 |
| 5,832,570 | A | 11/1998 | Thorpe et al. | 24/587 |
| 5,832,699 | A | 11/1998 | Zobel | 53/461 |
| 5,836,056 | A | 11/1998 | Porchia et al. | 24/400 |
| 5,839,831 | A | 11/1998 | Mazzocchi | 383/65 |
| D406,685 | S | 3/1999 | McGinnis | D2/641 |
| 5,878,468 | A | 3/1999 | Tomic et al. | 24/576 |
| 5,894,707 | A | 4/1999 | May | 53/133.7 |
| 5,902,046 | A | 5/1999 | Shibata | 383/107 |
| 5,911,508 | A | 6/1999 | Dobreski et al. | 383/5 |
| 5,927,855 | A | 7/1999 | Tomic et al. | 383/5 |
| 5,930,877 | A | 8/1999 | Thorpe et al. | 24/587 |
| 5,933,927 | A | 8/1999 | Miller et al. | 24/452 |
| 5,950,285 | A | 9/1999 | Porchia et al. | 24/400 |
| 5,953,796 | A | 9/1999 | McMahon et al. | 24/400 |
| 5,955,160 | A | 9/1999 | Tanaka et al. | 428/34.1 |
| 5,962,040 | A | 10/1999 | Dais et al. | 425/290 |
| 5,964,532 | A | 10/1999 | St. Phillips et al. | 383/5 |
| 5,988,880 | A | 11/1999 | Tomic | 383/63 |
| 6,004,032 | A | 12/1999 | Kapperman et al. | |
| 6,009,603 | A | 1/2000 | Gallagher | 24/587 |
| 6,010,244 | A | 1/2000 | Dobreski et al. | 383/63 |
| 6,014,795 | A | 1/2000 | McMahon et al. | 24/400 |
| 6,021,557 | A | 2/2000 | Dais et al. | 29/453 |
| 6,030,122 | A | 2/2000 | Ramsey et al. | 383/61 |
| 6,032,437 | A | 3/2000 | Bois | 53/412 |
| 6,071,011 | A | 6/2000 | Thomas et al. | 383/64 |
| 6,074,096 | A | 6/2000 | Tilman | 383/63 |
| 6,077,208 | A | 6/2000 | Larkin et al. | 493/223 |
| 6,080,252 | A | 6/2000 | Plourde | 156/66 |
| 6,085,906 | A | 7/2000 | Lambert | 206/524.8 |
| 6,110,586 | A | 8/2000 | Johnson | 428/352 |
| 6,112,374 | A | 9/2000 | Van Erden | 24/400 |
| 6,135,636 | A | 10/2000 | Randall | 383/64 |
| 6,138,329 | A | 10/2000 | Johnson | 24/587 |
| 6,148,588 | A | 11/2000 | Thomas et al. | 53/412 |
| 6,149,302 | A | 11/2000 | Taheri | 383/5 |
| 6,152,600 | A | 11/2000 | Tomic | 383/63 |
| 6,156,363 | A | 12/2000 | Chen et al. | 426/410 |
| 6,164,825 | A | 12/2000 | Larkin et al. | 383/104 |
| 6,167,597 | B1 | 1/2001 | Malin | 24/587 |
| 6,170,985 | B1 | 1/2001 | Shabram, Jr. et al. | 383/100 |
| 6,185,796 | B1 | 2/2001 | Ausnit | 24/587 |
| 6,187,396 | B1 | 2/2001 | Möller | 428/34.3 |
| 6,212,061 | B1 | 4/2001 | Irwin et al. | 361/502 |
| 6,217,215 | B1 | 4/2001 | Tomic | 383/63 |
| 6,217,216 | B1 | 4/2001 | Taheri | 383/207 |
| 6,221,484 | B1 | 4/2001 | Leiter | 428/343 |
| 6,228,485 | B1 | 5/2001 | Leiter | 428/343 |
| 6,231,236 | B1 | 5/2001 | Tilman | 383/63 |
| 6,257,763 | B1 | 7/2001 | Stolmeier et al. | 383/5 |
| 6,279,298 | B1 | 8/2001 | Thomas et al. | 53/412 |
| 6,286,681 | B1 | 9/2001 | Wilfong, Jr. et al. | 206/554 |
| 6,286,999 | B1 | 9/2001 | Cappel et al. | 383/5 |
| 6,299,720 | B1 | 10/2001 | Van Erden | 156/244.19 |
| 6,318,894 | B1 | 11/2001 | Derenthal | 383/204 |
| 6,321,423 | B1 | 11/2001 | Johnson | 24/585.12 |
| 6,360,513 | B1 | 3/2002 | Strand et al. | 53/412 |
| 6,364,915 | B1 | 4/2002 | Chapman-Irwin et al. | 29/25.03 |
| 6,461,042 | B1 | 10/2002 | Tomic et al. | 383/64 |
| 6,461,043 | B1 | 10/2002 | Healy et al. | 383/204 |
| 6,481,890 | B1 | 11/2002 | VandenHeuvel | 383/64 |
| 6,487,758 | B2 | 12/2002 | Shaffer et al. | 24/585.12 |
| 6,491,433 | B2 | 12/2002 | Shabram, Jr. et al. | 383/100 |
| 6,539,594 | B1 | 4/2003 | Kasai et al. | 24/585.12 |
| 6,582,122 | B2 | 6/2003 | Shimizu | 383/63 |
| 6,592,260 | B1 | 7/2003 | Randall et al. | 383/64 |
| 6,594,868 | B1 | 7/2003 | Savicki | 24/30.5 |
| 6,594,872 | B2 | 7/2003 | Cisek | 24/401 |
| 6,637,939 | B2 | 10/2003 | Huffer | 383/64 |
| 6,686,005 | B2 | 2/2004 | White et al. | 428/35.2 |
| 6,691,383 | B2 | 2/2004 | Linton | 24/585.12 |
| 6,712,509 | B2 | 3/2004 | Cappel | 383/5 |
| 7,137,736 | B2 * | 11/2006 | Pawloski et al. | 383/61.2 |
| 7,165,292 | B2 * | 1/2007 | Kasai | 24/30.5 R |
| 2001/0043763 | A1 | 11/2001 | Saad et al. | 383/63 |
| 2002/0034343 | A1 | 3/2002 | Bois | |
| 2002/0090151 | A1 | 7/2002 | Skeens et al. | 383/100 |
| 2002/0114540 | A1 | 8/2002 | Shimizu | 383/63 |
| 2002/0153273 | A1 | 10/2002 | Mallik et al. | 206/459.1 |
| 2002/0173414 | A1 | 11/2002 | Leighton | 493/213 |
| 2003/0033694 | A1 | 2/2003 | Cisek | 24/401 |
| 2003/0066267 | A1 | 4/2003 | Nelson | 53/412 |
| 2003/0077008 | A1 | 4/2003 | Plourde et al. | 383/63 |
| 2003/0077243 | A1 | 4/2003 | Fitzhugh et al. | 424/78.27 |
| 2003/0167607 | A1 | 9/2003 | Linton | 24/585.12 |
| 2003/0169947 | A1 | 9/2003 | Taheri | 383/5 |
| 2003/0169948 | A1 | 9/2003 | Fenzl et al. | 383/61.2 |
| 2003/0177619 | A1 | 9/2003 | Cisek | 24/585.12 |
| 2003/0210836 | A1 | 11/2003 | Strand | 383/9 |
| 2003/0219174 | A1 | 11/2003 | Piechocki | 383/59 |
| 2003/0223654 | A1 | 12/2003 | Gerrits | 383/63 |
| 2003/0223657 | A1 | 12/2003 | Belias et al. | 383/105 |
| 2004/0001650 | A1 | 1/2004 | Piechocki et al. | 383/59 |
| 2004/0047521 | A1 | 3/2004 | Berich et al. | 383/63 |
| 2004/0078940 | A1 | 4/2004 | Ishizaki | 24/400 |
| 2004/0091179 | A1 | 5/2004 | Anderson | 383/63 |
| 2004/0234171 | A1 | 11/2004 | Dais et al. | |
| 2005/0141786 | A1 | 6/2005 | Piechocki et al. | |
| 2005/0235468 | A1 | 10/2005 | Borchardt et al. | |
| 2005/0271307 | A1 | 12/2005 | Pawloski et al. | |
| 2005/0271308 | A1 | 12/2005 | Pawloski | |

FOREIGN PATENT DOCUMENTS

| | | | |
|---|---|---|---|
| CH | 540 162 A | 8/1973 | |
| DE | 831 985 | 2/1952 | 3/3 |
| DE | 2 036 432 | 2/1971 | 81/8 |
| DE | 30 32 889 | 12/1981 | 33/16 |
| EP | 0 025 656 | 3/1981 | 33/24 |
| EP | 0 089 680 | 9/1983 | |
| EP | 0 114 373 | 8/1984 | 33/16 |
| EP | 0 155 612 | 9/1985 | |
| EP | 0 220 476 | 5/1987 | 33/25 |
| EP | 0 241 334 | 10/1987 | 19/16 |
| EP | 0 398 731 | 11/1990 | 33/25 |
| EP | 0 427 010 | 5/1991 | 19/16 |
| EP | 0 543 737 | 5/1993 | 33/25 |
| EP | 1 038 774 | 9/2000 | 9/20 |
| EP | 1277668 | 1/2003 | |
| EP | 1 329 387 | 7/2003 | 61/18 |
| FR | 1493748 | 7/1967 | 29/44 |
| FR | 1 517 531 A | 3/1968 | |
| FR | 2620377 | 3/1989 | 5/10 |
| GB | 998967 | 7/1965 | |
| GB | 1092452 | 11/1967 | 65/8 |
| GB | 1156170 | 6/1969 | 27/20 |
| GB | 1326945 | 8/1973 | 27/20 |
| GB | 2008538 | 6/1979 | 33/14 |
| GB | 2116144 | 9/1983 | 33/1 |
| GB | 2 117 351 | 10/1983 | 33/24 |
| JP | 2-15437 | 1/1990 | |

| | | | |
|---|---|---|---|
| JP | 3 212355 | 9/1991 | ..... 33/10 |
| JP | 04057768 | 2/1992 | ..... 81/34 |
| JP | 6 99991 | 4/1994 | ..... 30/10 |
| JP | 6 227551 | 8/1994 | ..... 33/1 |
| WO | WO 88/04634 | 6/1988 | ..... 33/24 |
| WO | WO 0174676 | 10/2001 | |
| WO | WO 02/34634 | 5/2002 | ..... 33/2 |
| WO | WO 0247993 | 6/2002 | |

OTHER PUBLICATIONS

Web page from www.zippak.com "At-140 Zipper".
Web page from www.ambag.com "Double Track Seal Top Bags".
Web pages from www.ambag.com "Ambag Corporation Custom Plain Bag Guidelines" (7 pages).
Web pages from www.plastic-bags.net "Plastic Bags" (5 pages).
Photo-micrograph of "Fresh Pack Zipper" from Chantler Packaging (see http://www.chantlerpackaging.com).
Web pages of "Ziplock Bag," by Rean Tai Plastic Co., Ltd at http://www.reantai.ttnet.net, (4 pages).
Photographs of "Zipper Bag" from Thai Griptech Co., Ltd, of Thailand (3 pages).
Photo-micrograph of "Zipper Bag" from Thai Griptech Co., Ltd. of Thailand.
Photographs of "Ziploc Heavy Duty Big Bags" from S. C. Johnson & Son, Inc., Large 21/4 Gallon Size (8.52 L), (4 pages).
Photographs of "Vegetables & Fruits Fresh Pack" from Slim Kitchen, 280mm×270mm, (3 pages).
Photographs of "Breast Milk Storage Bags" from Lansinoh, (4 pages).
Web pages of "Breast Milk Storage Bags" by Lansinoh at http://store.babycenter.com/product/feeding/breastfeeding/pump accessories/3961, (2 pages).
Photographs of box for "Breast Milk Storage Bags" by Lansinoh, (2 pages).
Photographs of double zipper bag, name and origin unknown, (4 pages).
Web pages of "4-Mil Double-Track Zip Poly Bags" advertised by Realemall.com at http://office-supply.realemall.com/B-O-X-Packaging/4Mil-DoubleTrack-Zip-Poly-Bags.asp, 5 pages.
Web pages of "4-Mil Double-Track Zip Poly Bags" sold by Office Depot, 12"×15", Box Of 500, at http://www.officedepot.com/ddSKU.do?level=SK&id=499978, 2 pages.
Web article "MS-1000 Offers Maximum Versatility" Feb. 20, 2002 at http://www.packexpo.com/ve/34472/news/3070.html, 2 pages.
Web pages of "Drawstring Bags" advertised manufactured by Co-Ordinated Packaging, Inc. at http://www.co-ordinatedpackaging.com/specimen_bags.htm, 2 pages.
International Search Report and Written Opinion, Appl. No. PCT/US2004/015240.
Office Action in U.S. Appl. No. 10/875,391, filed Feb. 7, 2007.
Office Action in U.S. Appl. No. 10/875,391, filed Jun. 19, 2007.
Office Action in U.S. Appl. No. 10/440,822, filed Mar. 1, 2005.
Office Action in U.S. Appl. No. 10/440,822, filed May 23, 2005.
Office Action in U.S. Appl. No. 10/440,822, filed Nov. 4, 2005.
Office Action in U.S. Appl. No. 10/440,639, filed Feb. 11, 2005.
Office Action in U.S. Appl. No. 10/440,639, filed Jul. 26, 2005.
Office Action in U.S. Appl. No. 10/440,639, filed Nov. 18, 2005.
Office Action in U.S. Appl. No. 10/440,639, filed May 17, 2006.
Office Action in U.S. Appl. No. 10/861,674, filed Mar. 8, 2007.
U.S. Appl. No. 10/861,674, Office action dated Apr. 25, 2007.

* cited by examiner

CLOSURE DEVICE FOR A RECLOSABLE POUCH

CROSS REFERENCE TO RELATED APPLICATIONS

The present application is a continuation-in-part of U.S. patent application Ser. No. 10/440,639, filed on May 19, 2003 now U.S. Pat. No. 7,137,736.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to closures for reclosable pouches, and more particularly, to such closures that include two closure mechanisms comprised of male and female closure elements.

2. Description of the Background of the Invention

A thermoplastic bag for the storage of items typically includes a closure mechanism comprising multiple profiles disposed on opposed inner surfaces of bag walls. In a specific example, two sets of profiles are disposed on the bag walls wherein each set includes a male and a female closure element.

Ausnit U.S. Pat. No. 3,656,147 discloses a plastic bag having male and female resealable interlocking elements integrally attached thereto for selectively opening and closing an end of the bag. The bag further includes a pair of stiffener ribs formed integrally with the bag and disposed below the resealable elements to provide increased rigidity along an open end of the bag to prevent inadvertent separation of the elements.

Johnson U.S. Pat. No. 6,138,329 discloses a reclosable bag having an assembly that includes first and second male arrow-shaped profiles extending perpendicularly from a first base. The assembly further includes first and second female U-shaped members extending perpendicularly from a second base to engage the first and second male profiles, respectively. Each of the male arrow-shaped profiles includes two prongs extending therefrom that engage with a female profile. The prongs of the second male profile are longer than the prongs of the first male profile to increase the opening force of the second male profile when interlocked with a respective female profile.

Malin U.S. Pat. No. 6,167,597 discloses a zipper strip for a reclosable package, wherein the zipper strip includes a male and a female profile. There are at least two male interlocking members that extend from a base toward the opposite female interlocking members, wherein each male member has an asymmetrical arrow shape so that the zipper is easier to open from one side than the other. One or both of the profiles includes at least one high compression member that extends from a base thereof to touch a base of the opposite profile to allow the profiles to be sealed without crushing or distorting the interlocking members.

SUMMARY OF THE INVENTION

According to one aspect of the present invention, a reclosable pouch comprises a body portion having first and second bag walls. A first closure mechanism comprises a first male closure element and a first female closure element, wherein the first female closure element has first and second spaced legs. The first male and first female closure elements are disposed on opposing sides of the first and second bag walls. A second closure mechanism comprises a second male closure element and a second female closure element, wherein the second female closure element has third and fourth spaced legs. The second male and second female closure elements are disposed on opposing sides of the first and second bag walls. The first male closure element includes two hook portions extending from an end thereof to engage the legs of the first female closure element and the second male closure element includes only one hook portion extending from an end thereof to engage one of the legs of the second female closure element.

According to another aspect of the present invention, a reclosable pouch comprises a body portion having first and second bag walls. A first closure mechanism comprises a first male closure element and a first female closure element, wherein the first female closure element has first and second spaced legs. The first male and first female closure elements are disposed on opposing sides of the first and second bag walls. A second closure mechanism comprises a second male closure element and a second female closure element, wherein the second female closure element has third and fourth spaced legs. The second male and second female closure elements are disposed on opposing sides of the first and second bag walls. The first male closure element includes two hook portions extending from an end thereof to engage the legs of the first female closure element and the second male closure element includes only one hook portion extending from an end thereof to engage one of the legs of the second female closure element. The first male closure element disengages from the first female closure element with a first opening force and the second male closure element disengages from the second female closure element with a second opening force that is different than the first opening force.

In yet another embodiment of the present invention, a reclosable pouch comprises a body portion having first and second bag walls. A first closure mechanism comprises a first male closure element and a first female closure element, wherein the first female closure element has first and second spaced legs. The first male and first female closure elements are disposed on opposing sides of the first and second bag walls. A second closure mechanism comprises a second male closure element and a second female closure element, wherein the second female closure element has third and fourth spaced legs. The second male and second female closure elements are disposed on opposing sides of the first and second bag walls. The first male closure element includes two hook portions extending from an end thereof to engage the legs of the first female closure element and the second male closure element includes only one hook portion extending from an end thereof to engage one of the legs of the second female closure element. The first male closure element engages with the first female closure element with a first closing force and the second male closure element engages with the second female closure element with a second closing force that is different than the first closing force.

In a further embodiment of the present invention, a zipper tape comprises a first zipper tape portion and a second zipper tape portion. The first zipper tape portion includes a first inner surface and the second zipper tape portion includes a second inner surface. A first closure mechanism comprises a first male closure element and a first female closure element, wherein the first female closure element has first and second spaced legs. The first male and first female closing elements are disposed on opposing sides of first and second inner surfaces. A second closure mechanism comprises a second male closure element and a second female closure element, wherein the second female closure element has third and fourth spaced legs. The second male and second female closure elements are disposed on opposing sides of the first and second inner surfaces. Further, the first male closure element includes two hook portions extending from an end thereof to engage the legs of the first female closure element and the second male closure element includes only one hook portion extending from an end thereof to engage one of the legs of the second female closure element.

Other aspects and advantages of the present invention will become apparent upon consideration of the following detailed description and the attached drawings, in which like elements are assigned like reference numerals.

DETAILED DESCRIPTION OF THE DRAWINGS

Figure 1:
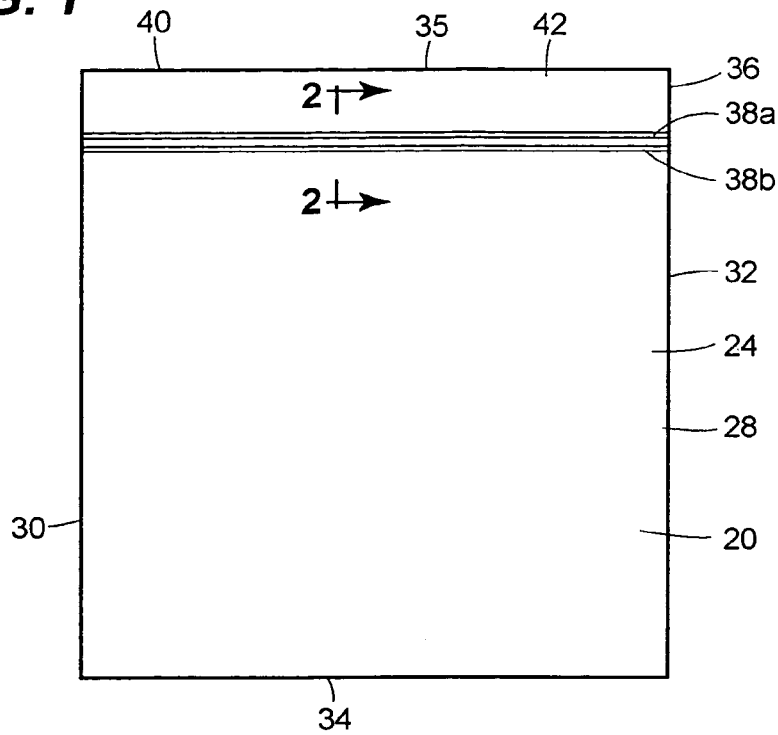
FIG. 1 is an elevational view of a reclosable thermoplastic storage bag incorporating the present invention.

Referring to FIG. 1, a reclosable pouch in the form of a thermoplastic storage bag 20 comprises first and second body portions 22, 24 joined to one another to form first and second bag walls 26, 28. The first and second bag walls 26, 28 are joined at first and second side portions 30, 32, respectively, and at a bottom portion 34. An opening 35 is disposed at a top portion 36 of the bag 20. First and second closure mechanisms 38*a*, 38*b* and two lips 40 are also disposed at the top portion 36 of the bag 20. The first closure mechanism 38*a* is disposed between the second closure mechanism 38*b* and an upper edge 42 of the top portion 36.

Figure 2A:
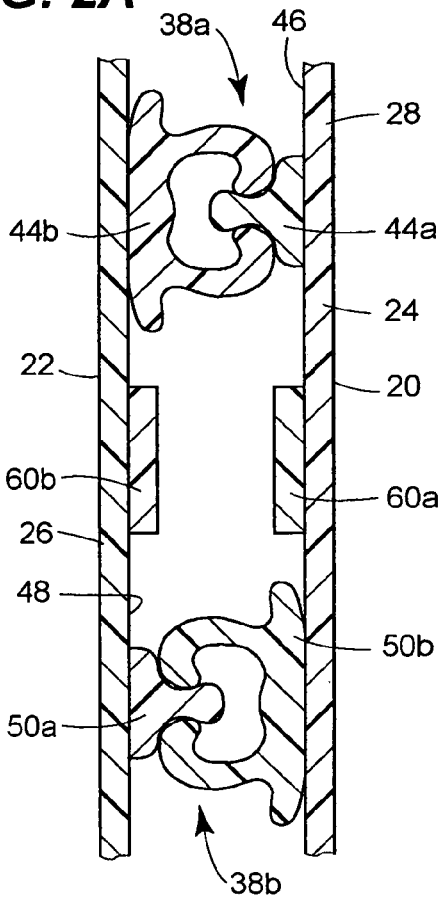
FIG. 2A is an enlarged, fragmentary, sectional view taken generally along the lines 2-2 of FIG. 1.
Figure 2B:
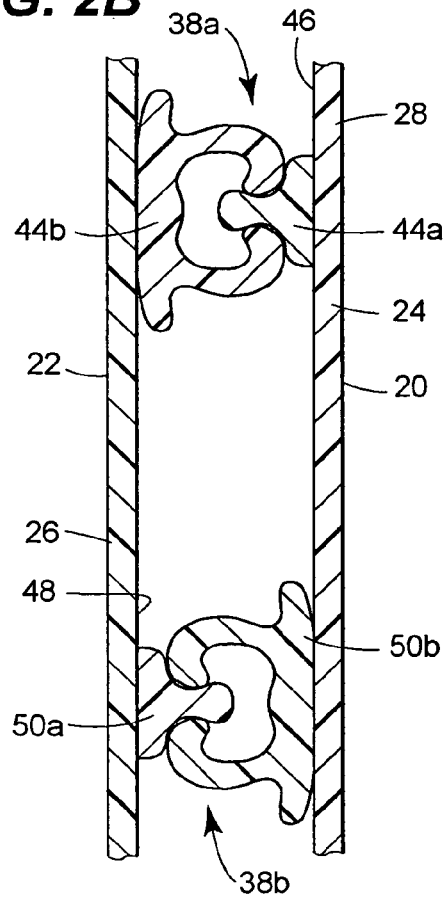
FIGS. 2B, 3, and 4 are views similar to FIG. 2A illustrating alternative embodiments of the present invention.

Referring to FIG. 2B, male and female closure elements or portions 44*a*, 44*b* of the closure mechanism 38*a* are disposed on opposing internal sides or surfaces 46, 48 of the first and second body portions 22, 24, respectively. In addition, in the embodiment of FIG. 2B, male and female elements or portions 50*a*, 50*b* of the closure mechanism 38*b* are disposed on the internal sides or surfaces 48, 46, respectively. Preferably, although not necessarily, the closure mechanism 38*a* is parallel to the closure mechanism 38*b* and the two are spaced from one another by a distance that is sufficiently small to create the perception that mechanisms act as a single closure. In addition, the mechanisms 38*a*, 38*b* are preferably disposed sufficiently far apart such that a user's fingers and/or thumb are guided during the closing operation. Typically, these results are accomplished by spacing the mechanisms 38*a*, 38*b* between about 0.1 inch (2.54 mm) and 0.3 inch (7.62 mm) apart, and, more preferably, between about 0.15 inch (3.81 mm) and about 0.25 inch (6.35 mm) apart and most preferably about 0.20 inch (5.08 mm) apart, although a different spacing may instead be used.

Preferably, the closure elements or portions 44, 50 have a cross sectional shape and/or may be formed in accordance with the teachings of Geiger, et al. U.S. Pat. No. 4,755,248, Zieke et al., U.S. Pat. No. 4,741,789, and/or Porchia et al., U.S. Pat. No. 5,012,561, owned by the assignee of the present application and the disclosures of which are hereby incorporated by reference herein. Also preferably, the first closure mechanism 38*a* exhibits a first closure characteristic and the second closure mechanism 38*b* exhibits a second closure characteristic different than the first closure characteristic. For example, either or both of the first and second closure mechanisms 38 may exhibit a relatively low level of resistance to bag opening forces but provide a high level of deformation so as to exhibit a clicking feel and/or sound when the bag is opened or closed. In addition, either or both of the first and second closure mechanisms 38 may exhibit a low level of deformation but provide a relatively high overall resistance to bag opening forces. Either or both of the male closure elements 44*a*, 50*a* may be symmetric or asymmetric about a longitudinal centerline thereof and either or both of the female closure elements 44*b*, 50*b* may be symmetric or asymmetric about a longitudinal centerline thereof. Thus, for example, either or both of the first and second closure mechanisms 38 may have an asymmetric configuration so that the closure mechanism 38 exhibits a first resistance to opening forces exerted on one side of the mechanism 38 and further exhibits a second, different resistance to opening forces exerted on another side of the mechanism 38.

In a specific embodiment, the first closure mechanism 38*a* exhibits a high degree of deformation so as to develop a clicking feel when the bag is opened or closed. Preferably, the first closure mechanism 38*a* is produced in accordance with the teachings of Dais et al., U.S. Pat. No. 5,140,727, owned by the assignee of the present application and the disclosure of which is hereby incorporated herein. In addition, the second closure mechanism 38*b* provides a relatively high overall resistance to opening forces. In addition, each closure mechanism 38*a* and 38*b* exhibits a first resistance to opening forces exerted from inside the bag (i.e., on the side between the bottom portion 34 of the bag and the closure mechanisms 38) and a second, lower resistance to opening forces exerted from the opposite side of the closure mechanisms 38 (i.e., on the side between the upper edge 42 and the closure mechanisms 38.) This differential opening force characteristic is accomplished by asymmetrically configuring the male closure elements 44*a* and 50*a* and/or the female closure elements 44*b* and 50*b* as noted above. In the preferred embodiment, each of the closure mechanisms 38*a*, 38*b* exhibits substantially the same first resistance to opening forces exerted on the side between the upper edge 42 and the closure mechanisms 38. In addition, each of the closure mechanisms 38*a*, 38*b* exhibits substantially the same second resistance to opening forces originating between the bottom portion 34 of the bag and the closure mechanisms 38. The second resistance is greater than the first resistance. It should be noted that the first closure mechanism 38*a* may provide the same or different resistance to opening forces as compared with the resistance provided by the second closure mechanism 38*b* with respect to forces originating from inside the bag and/or from the opposite side of the closure mechanism 38.

In addition, if desired, both of the closure mechanisms 38*a* and 38*b* or just the closure mechanism 38*b* may exhibit a high degree of deformation so as to develop a clicking feel when the bag is opened or closed. Still further, more than two closure mechanisms 38 may be provided wherein the closure mechanisms 38 have differing or the same closure characteristic(s) and the closure mechanisms act together as a single unit to allow the user to open and close the bag.

Figure 3:
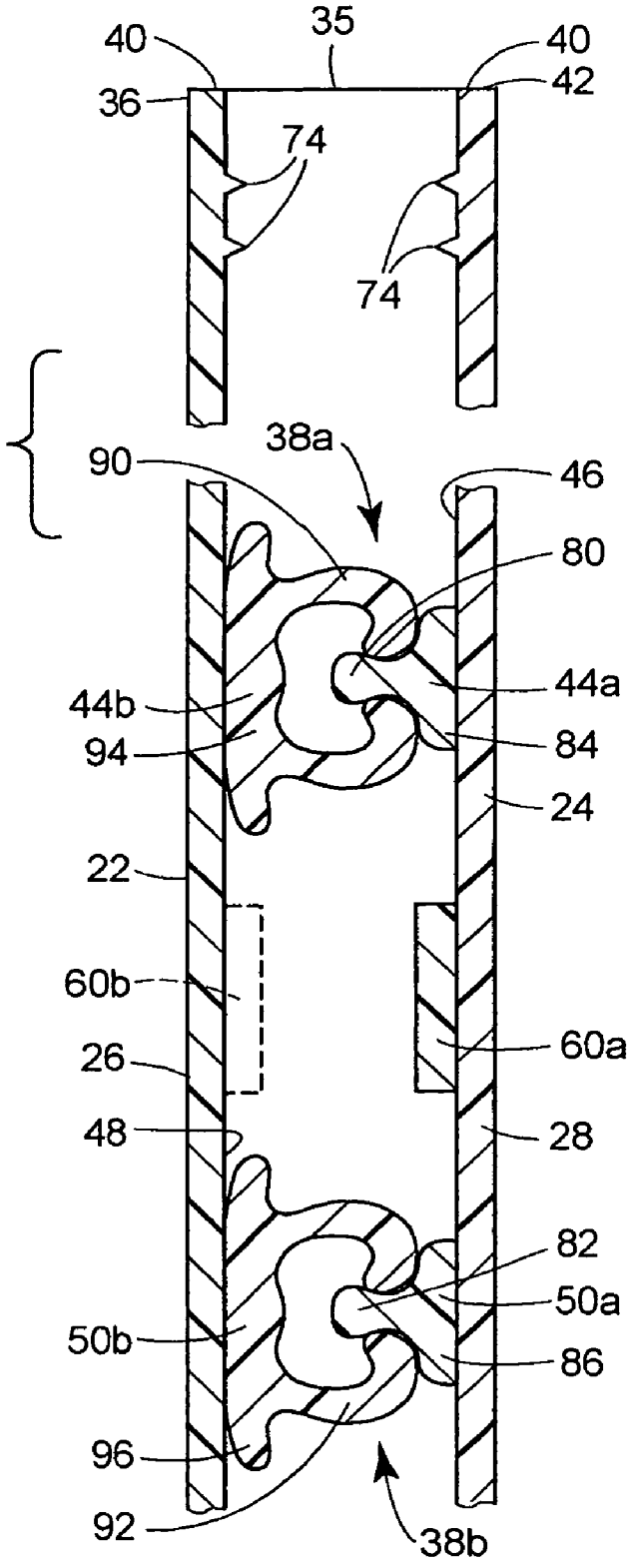
Figure 4:
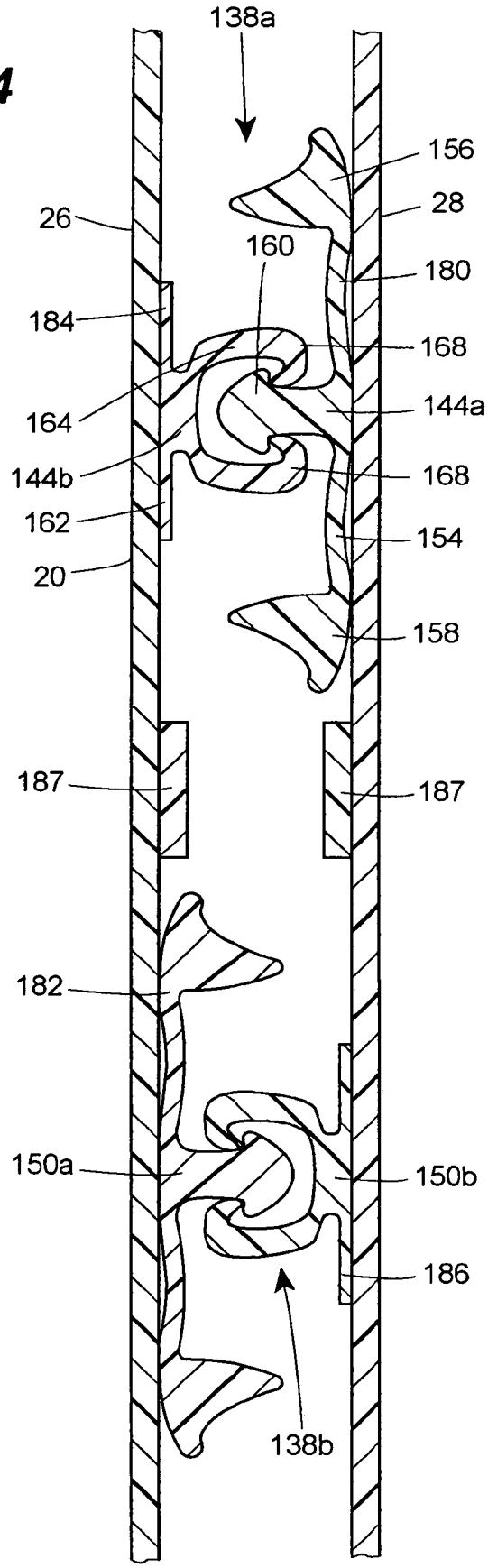

If desired, and as seen in FIGS. 2A, 3, and 4, one or more strips 60 could be provided between the closure mechanisms 38*a*, 38*b* (optionally out of contact, i.e., not touching, the adjacent closure elements) on either or both of the internal sides or surfaces 46, 48. The strips 60 may be colored or uncolored and may lend stiffness to the structure. According to a first embodiment, the male closure element 44*a*, the female closure element 50*b* and an optional strip 60*a* disposed between the elements 44*a* and 50*b* are colored pink, whereas the female closure element 44*b* and the male closure element 50*a* are colored blue. An optional further strip 60*b* may be disposed on the surface 48 between the closure elements 44*b* and 50*a* and may be colored blue. The size and shape of the strips 60 may be selected as desired to obtain a desired feel and/or stiffness.

As a further alternative, each of the optional strips 60 may simply comprise a thin colored coating, such as very thin layer of colored thermoplastic, a colored epoxy, a layer of paint, etc . . .

FIG. 3 illustrates a further embodiment wherein like reference numbers denote structures common to the various embodiments. As seen in FIG. 3, the male closure elements 44*a* and 50*a* are disposed on the internal side or surface 46 and the female closure elements 44*b* and 50*b* are disposed on the internal side or surface 48. In this embodiment, a single strip 60*a* is provided between the male elements 44*a* and 50*a* on the internal side or surface 46. Additionally or alternatively, a strip 60*b* (seen in phantom in FIG. 3) may be provided between the female closure elements 44*b* and 50 on the internal side or surface 48. One or more additional strips may be provided on either or both surfaces 46, 48. If desired, other structures might be included with the closure mechanisms and the strips. For example, one or more guide ribs (not shown) could be provided to further assist in guiding of the user's fingers. Further, any or all of the strips 60 and/or other structures may be disposed between the closure mechanisms 38*a*, 38*b* or may be disposed outside of (i.e., above or below as seen in FIG. 1) the mechanisms 38*a*, 38*b*.

In any of the embodiments disclosed herein, one or more gripping ribs 74 may be disposed on the internal surfaces 46, 48 of the bag 20 between the closure mechanisms 38*a* and 38*b* and the top portion 36 of the bag 20, wherein the gripping ribs 74 are integrally extruded with the walls of the bag. Any number of gripping ribs 74 can be used, although space is necessary between adjacent ribs in order to facilitate a gripping action with a user's fingers. In a preferred embodiment, about six or seven gripping ribs 74 are disposed on each lip 40 of the bag.

As seen in FIG. 3, each male closure element 44*a*, 50*a* comprises an arrow-shaped engagement member 80, 82, respectively, and a base member 84, 86, respectively. Each female closure element 44*b*, 50*b* comprises a C-shaped profile member 90, 92, respectively, joined to base members 94, 96, respectively. The base members 84, 86 are only slightly wider than the engagement members 80, 82 and the base members 94, 96 are only slightly wider than the side-to-side extent (as seen in FIG. 2A) of the C-shaped profile members 90 and 92. The same is true of the embodiment of FIG. 2A. In both of these embodiments relatively little resin is required to form the closure mechanisms 38. In fact, it is believed that only a minimal increase in resin is needed to produce the closure elements 38 compared to a standard bag design utilizing a single closure mechanism, and yet a closure is obtained that has a wide-track feel and superior resistance to inadvertent opening.

FIG. 4 illustrates yet another embodiment of the present invention wherein the closure mechanisms 38*a*, 38*b* are replaced by closure mechanisms 138*a*, 138*b*. The mechanism 138*a* includes male and female closure elements 144*a*, 144*b* and the mechanism 138*b* includes male and female closure elements 150*a*, 150*b*. The mechanisms 138*a*, 138*b* are identical, and hence, only the closure mechanism 138*a* will be discussed in detail. The male closure element 144*a* of the closure mechanism 138*a* comprises a base 154 integral with flanking side members 156 and 158 and an arrow-shaped engagement member 160 that extends from the base 154. A female closure element 144*b* comprises a base 162 with a C-shaped profile member 164 extending therefrom, wherein the female closure element 144*b* is adapted to receive the male closure element 144*a* when pressure is exerted on the closure elements by a user's finger(s) during closing of the bag. The side members 156 and 158 are of a sufficient size and proximity to the engagement member 160 such that the side members 156 and 158 move together with the member 160 when the members 160 and 164 are engaged and disengaged. The side members 156 and 158 also have a height that is less than the height of the engagement member 160, and the members 156 and 158 extend beyond tips 168 of the female profile member 164 when the engagement member 160 is engaged with the female profile member 164. Thus, at such time, the tips 168 of the female profile member 164 reside between the side members 156 and 158 and the male engagement member 160.

As in the previous embodiments, the male closure elements 144*a*, 150*a* may be disposed on the same bag wall or on different bag walls, as may the female closure elements 144*b*, 150*b*.

As should be evident by a comparison of FIGS. 3 and 4, the base members 84, 86, 94, and 96 of FIG. 3 are replaced by elongate members 180, 182, 184, 186, respectively, and hence, more resin is required to produce the closure mechanisms 138*a*, 138*b* as compared to the closure mechanisms 38*a*, 38*b*. However, the elongate members 180-186 further promote guiding of the user's fingers and thumb during closing of the bag. One or more strips 187 identical or similar to the strip(s) 60 may be provided as noted in connection with the previous embodiments.

Figure 4A:
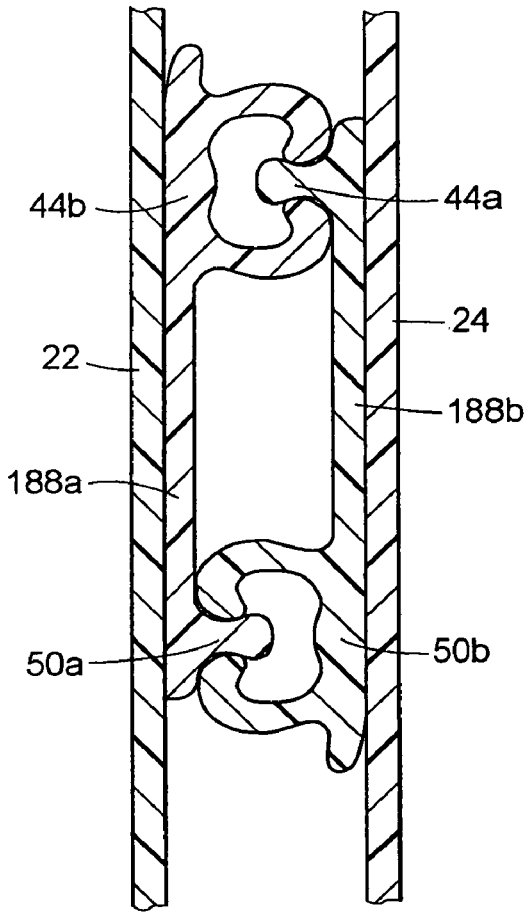
FIGS. 4A-4D are views also similar to FIG. 2A illustrating further alternative embodiments of the present invention.
Figure 4B:
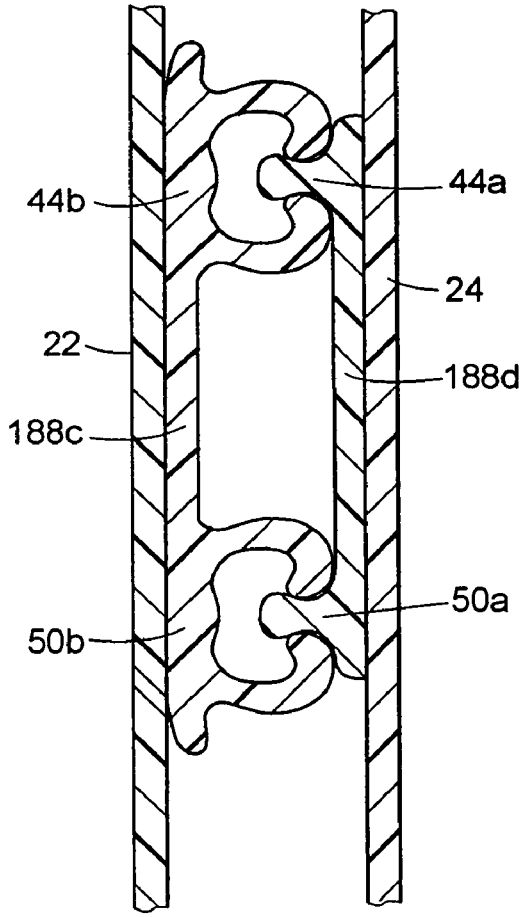

If desired, in any of the embodiments described herein, adjacent closure elements may be interconnected by a web of film. Thus, for example, FIG. 4A illustrates modifications to the embodiment of FIG. 2A wherein the female closure element 44*b* is interconnected to the male closure element 50*a* by a web 188*a* that is integrally or separately extruded with the elements 44*b* and 50*a*. In addition, the male closure element 44*a* may be interconnected to the female closure element 50*b* by a web 188*b* that is integrally or separately extruded with the elements 44*a*, 50*b*. FIG. 4B illustrates the same features in connection with the embodiment of FIG. 3. That is, in FIG. 4B, the female closure elements 44*b* and 50*b* are interconnected by a web 188*c* whereas the male closure elements 44*a* and 50*a* are interconnected by a web 188*d*.

Optionally, in FIGS. 4A and 4B, the closure elements 44, 50 and/or the webs 188*a*-188*d* may have the same or different visual characteristic(s). Suitable visual characteristics include visual material characteristics such as transparency, translucency or opaqueness, coloring of transparent, translucent, or opaque material by dye or other suitable colorants, printing or embossing of indicia, or the like. For example, portions or the entirety of the web 188*a* may have a first visual characteristic, such as pink coloring, and portions or the entirety of the web 188*b* may have a second, different visual characteristic, such as blue coloring. In addition, and taking the embodiment of FIG. 4A as an example, portions or the entirety of one or both of the closure elements 44*a* and 50*b* may have the same or a different visual characteristic as the web 188*b* or 188*a*. The same may be true of the closure elements 44*b*, 50*a* relative to the visual characteristic of the web 188*a* or 188*b*. When the respective closure elements 44*a*, 44*b* and 50*a*, 50*b* are mated, the first and second visual characteristics, such as the pink and blue colorings, respectively (if used), blend together to form a single visual characteristic, such as purple coloring, indicating full closure thereof. If desired, central portions of the webs 188*a*, 188*b* intermediate the closure elements 44*b*, 50*a* and 44*a*, 50*b*, respectively, (or corresponding intermediate portions of the webs 188*c*, 188*d*) may be thickened so that such portions come into contact with one another when the closure elements 44, 50 are occluded. This can enhance the color change effect and provide a tactile confirmation of closure. In addition to the foregoing, any of the webs may include any tactile characteristic including, but not limited to, embossing, a thicker feeling, or a cushioned feeling. Alternatively, intermittent portions along the lengths of the closure elements 44, 50 and/or webs 188*a*-188*d* may have any visual or tactile characteristic. For example, referring to the embodiment of FIG. 4B, the web 188*c* may have a first alternating pattern formed by separate portions along the length thereof (i.e., from side-to-side of the bag 20) that have a visual characteristic comprising pink coloring and remainder portions of the web 188*c* intermediate the pink portions that have a different visual characteristic, such as translucent uncolored (i.e., clear) portions. In addition, the web 188*d* may have a second alternating pattern of pink and clear (or another visual characteristic) portions that are disposed at least partially out of phase with respect to the first alternating pink and clear (or other visual characteristic) pattern of the web 188*c*. Preferably, although not necessarily, the first alternating pattern is a regular pattern (i.e., the pink portions are all of substantially the same first length, and the remaining clear portions are all of substantially the same second length, where the first and second lengths are equal or unequal) and the second alternating pattern is identical to the first alternating pattern, but is displaced 180 degrees with respect thereto. When the closure elements 44*a*, 44*b* and 50*a*, 50*b* are correctly mated, the alternating pink and clear (or other visual characteristic) portions of the webs 188*c*, 188*d* come together to form a substantially full line of substantially uniform color (or other visual characteristic) to indicate closure thereof. As should be evident from the foregoing, any portion of any of the webs 188 and/or closure elements 44, 50 may be any visual characteristic, including different colors, clear, translucent, or opaque material, or printed indicia, and opposite webs and/or closure elements 44, 50 may have the same visual characteristic(s) or different visual characteristic(s) to assist in providing a visual indication of at least partial occlusion of the closure elements 44, 50.

Figure 4C:
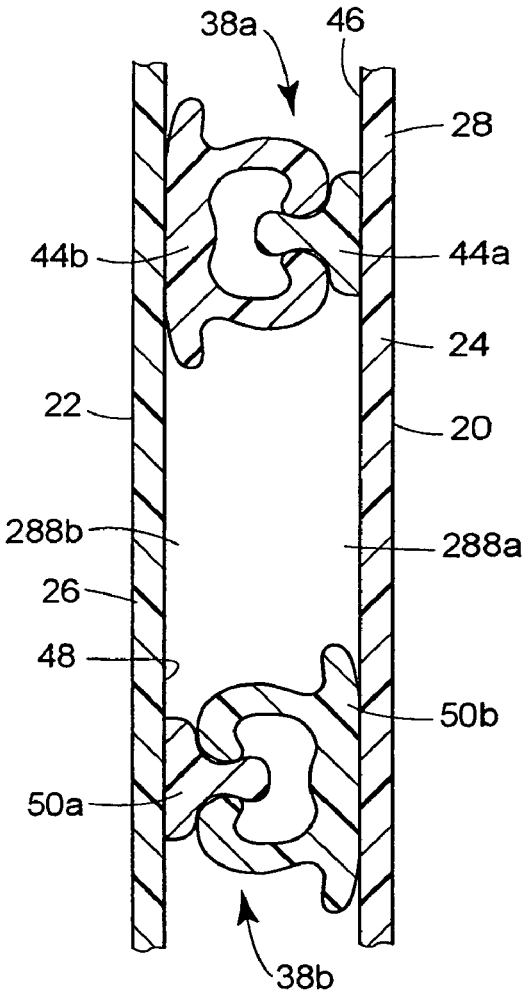
Figure 4D:
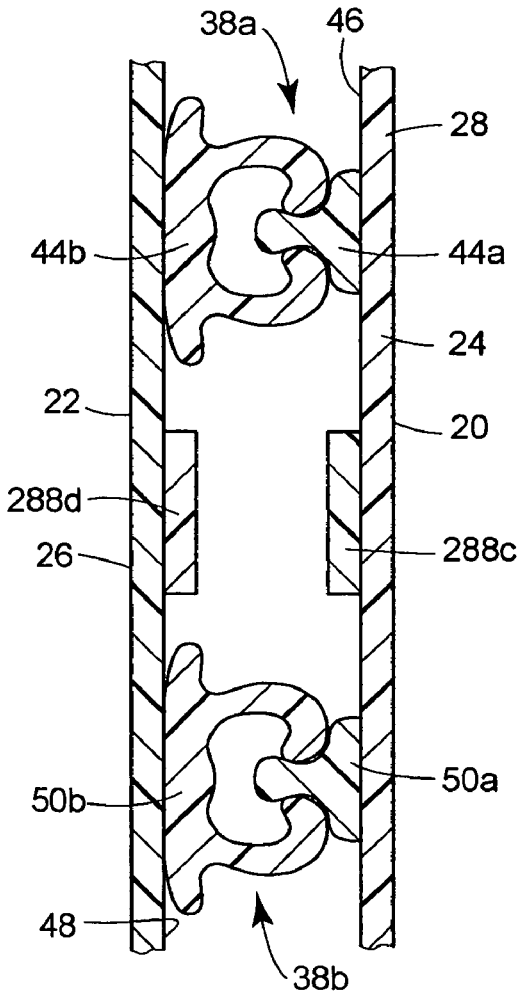

As seen in FIGS. 4C and 4D, webs 288*a*-288*d* may also be separately extruded onto the body portions 22, 24 intermediate and separate from the closure elements 44*a*, 44*b*, 50*a*, and 50*b*. Any of the embodiments described above in connection with FIGS. 4A and 4B are possible for the configurations shown in FIGS. 4C and 4D. The webs 288*a*-288*d* may also be made from any material including, but not limited to, a thermoplastic material or a foam material. For example, in FIG. 4C, the web 288*a* may have a first visual characteristic such as a translucent blue coloring and the web 288*b* may have a second visual characteristic such as a translucent yellow coloring, such that when the respective closure elements 44*a*, 44*b* and 50*a*, 50*b* are mated, the blue and yellow colors blend together to form a visual characteristic such as a green color that indicates full closure of the closure elements 44*a*, 44*b* and 50*a*, 50*b*. Further, in FIG. 4D, intermittent portions of the web 288*c* may have any visual characteristic, such as white coloring, to form a third regular or irregular alternating pattern of alternating white and clear portions and intermittent portions of the web 288*d* may have a visual characteristic including white coloring to form a fourth regular or irregular pattern of alternating white and clear portions wherein the third pattern is preferably (although not necessarily) identical to the fourth pattern, but displaced 180 degrees with respect thereto. As in the previous embodiment, when the closure elements 44*a*, 44*b* and 50*a*, 50*b* are mated, the alternating portions of the web portions 288*c*, 288*d* line up to from a full line of a visual characteristic (in this embodiment, a continuous white line) to indicate closure thereof. Also as in the previous embodiment, the thicknesses of the webs 288*c*, 288*d* may be such that at least portions of the webs 288*c*, 288*d* contact one another to enhance color change when the closure elements 44, 50 are properly mated.

As mentioned above, any of the webs 188*a*-188*d* or 288*a*-288*d* may have a visual characteristic including printed indicia thereon. For example, a first web may comprise a clear material with printed indicia including, for example, the word "closed" printed on an inner surface thereof and a second, opposing web may have a visual characteristic comprising a clear material. When the respective closure mechanisms are mated, the word "closed" appears through the second web to indicate full closure thereof. Alternatively, a word such as "closed" may be printed on inner surfaces of first and second clear webs at laterally spaced locations such that when the respective closure mechanisms are properly mated, the word "closed" appears clearly through the first and second webs at the laterally spaced locations to indicate full closure thereof. Printed indicia are not limited to words, but can also include any number, patterns, designs, or the like.

Figure 5:
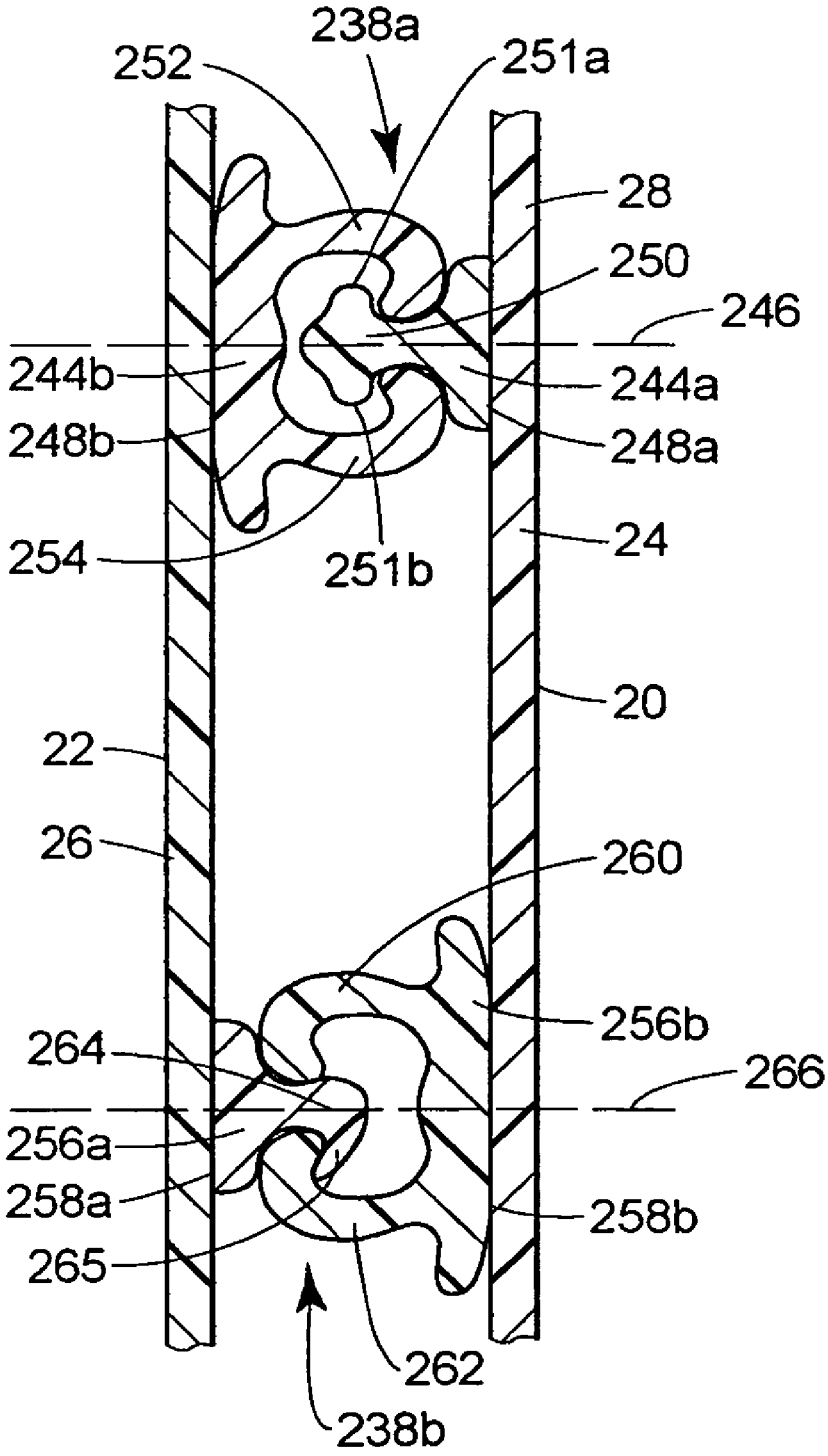
FIG. 5 is a view similar to FIG. 2A illustrating an alternative embodiment of the present invention.

FIG. 5 illustrates yet another embodiment of the present invention, wherein the closure mechanisms 38*a*, 38*b* are replaced by first and second closure mechanisms 238*a*, 238*b*, respectively. The first closure mechanism 238*a* comprises a first male closure element 244*a* and a first female closure element 244*b*. Both the first male and female closure elements 244*a*, 244*b* are substantially symmetric about a centerline 246, as may be seen in FIG. 5. The first male closure element 244*a* includes an engagement member 250 having two hook portions 251*a*, 251*b* that extend from a base 248*a*. The first female closure element 244*b* includes a base 248*b* with a first spaced leg 252 and a second spaced leg 254 extending therefrom. The first female closure element 244*b* is adapted to receive the first male closure element 244*a* when pressure is exerted on the closure elements by a user's finger(s) during closing of the bag. In a preferred embodiment, the second closure mechanism 238*b* comprises a second male closure element 256*a* and a second female closure element 256*b*. In this embodiment, the first female closure element 244*b* of the first closure mechanism 238*a* is substantially or completely identical to the second female closure element 256*b* of the second closure mechanism 238*b*. As such, the second female closure element 256*b* includes a base

Figure 5A:
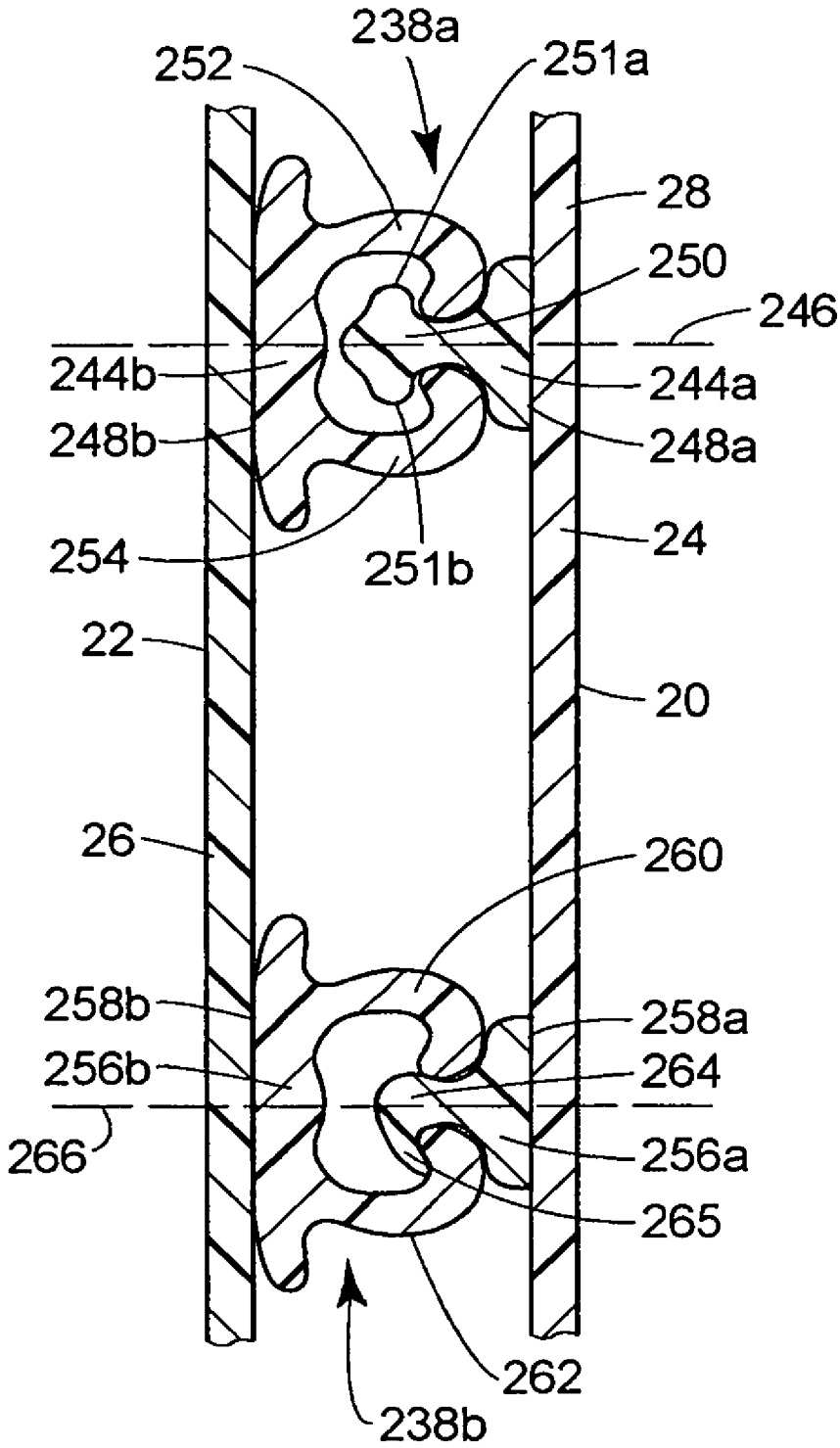
FIG. 5A is a view similar to FIG. 5 illustrating an alternative embodiment of the present invention.

258*b* with a third spaced leg 260 and a fourth spaced leg 262 extending therefrom. The second female closure element 256*b* is also adapted to receive the second male closure element 256*a* when pressure is exerted on the closure elements by a user's finger(s) during closing of the bag. The second male closure element 256*a* includes an engagement member 264 comprising only one hook portion 265 that extends from a base 258*a*. As should be evident, the second male closure element 256*a* is substantially asymmetric about a longitudinal centerline 266. As may be seen in FIG. 5, the first female closure element 244*b* of the first closure mechanism 238*a* is adjacent the second male closure element 256*a* of the second closure mechanism 238*b* on the first bag wall 26. The first female closure element 244*b* is also disposed closer to an upper edge 42 of the pouch on the first bag wall 26 than the second male closure element 256*a*. Additionally, the first male closure element 244*a* of the first closure mechanism 238*a* is adjacent the second female closure element 256*b* of the second closure mechanism 238*b* on the second bag wall 28. The first male closure element 244*a* is disposed closer to an upper edge 42 of the pouch on the second bag wall 28 than the second female closure element 256*b*. In another embodiment depicted in FIG. 5A, the first female closure element 244*b* of the first closure mechanism 238*a* is adjacent the second female closure element 256*b* of the second closure mechanism 238*b* on the first bag wall 26, while the first male closure element 244*a* of the first closure mechanism 238*a* is adjacent the second male closure element 256*a* of the second closure mechanism 238*b* on the second bag wall 28.

Figure 5B:
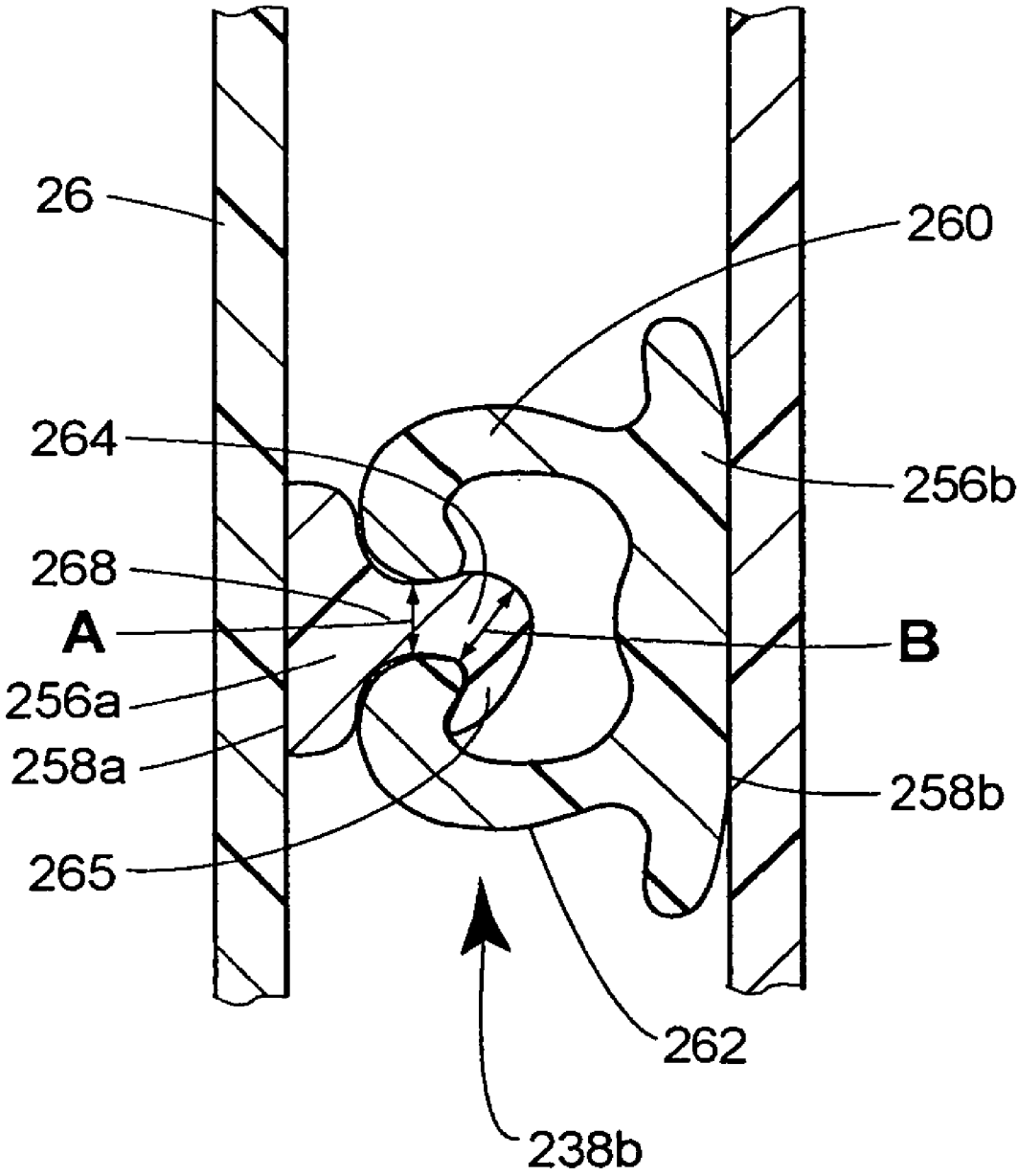
FIG. 5B is an enlarged fragmentary view of FIG. 5.

In a preferred embodiment, the first closure mechanism 238*a* is opened by disengaging its respective closure elements 244*a*, 244*b* with a first opening force and the second closure mechanism 238*b* is opened by disengaging its respective closure elements 256*a*, 256*b* with a second opening force. Both the first and second opening forces comprise respective internal and external opening forces. In one embodiment, the first male closure element 244*a* disengages from the first female closure element 244*b* with a first external opening force and the second male closure element 256*a* disengages from the second female closure element 256*b* with a second external opening force. The first and second external forces are substantially exerted from a side of the bag nearer the upper edge 42, as opposed to internal bursting forces that act on the closure mechanisms 238*a*, 238*b* from within the pouch. In a preferred embodiment, the first closure mechanism 238*a* primarily determines the external opening force of the bag whereby the first external opening force is larger than the second external opening force. This difference in forces results from the fact that first male closure element 244*a* of the first closure mechanism 238*a* has the hook portion 251*a* whereas the second male closure element 244*a* lacks a hook portion in a corresponding location (i.e., toward the upper edge 42). The elimination of an extra portion on the opposing side (toward the upper edge 42) of the engagement member 264 allows for the second female closure element 256*b* to flex less around the second male closure element 256*a* during opening of the bag 20. The result of the reduced flexing in the second closure mechanism 238*b* is a lower external opening force than exhibited by the first closure mechanism 238*a*. Additionally, as seen in FIG. 5B, the second male closure element 256*a* has a thickness A at a root portion 268 of the engagement member 264 and a thickness B at the widest part of the hook portion 265. In a preferred embodiment, the thicknesses A and B are substantially equal. Alternatively, the thickness B can be increased, thereby increasing the external opening force developed by the closure mechanism 238*b*.

Like the other embodiments, the embodiment illustrated in FIG. 5 includes two closure mechanisms wherein the first closure mechanism 238*a* exhibits a first closure characteristic and the second closure mechanism 238*b* exhibits a second closure characteristic. Preferably, the second closure characteristic comprises a first resistance to an external opening force applied to a first side of the second closure mechanism 238*b* and a second resistance to an internal opening force applied to a second side of the second closure mechanism 238*b*. As mentioned above, the second closure mechanism 238*b* preferably has a very low external opening force because the second male closure element 256*a* includes only one hook portion 265 that is directed toward the inside of the bag 20. Therefore, the second closure mechanism 238*b* is more apt to withstand internal bursting forces as opposed to external opening forces. The first closure mechanism 238*a*, in effect, controls the external opening force of the bag 20, whereas the second closure mechanism 238*b* primarily determines the resistance to burst forces exerted from within the bag 20.

In a further embodiment of the present invention, the first closure mechanism 238*a* exhibits a clicking feel and/or sound when the bag is opened or closed. Such a clicking feel is created by providing a high level of deformation within the first closure mechanism 238*a*. The first male and female closure elements 244*a*, 244*b* may be similar in structure to the embodiments characterized in FIGS. 2A and 2B, which also provide for a high level of deformation.

As should be evident, the first male closure element 244*a* engages with the first female closure element 244*b* with a first closing force and the second male closure element 256*a* engages with the second female closure element 256*b* with a second closing force. In one embodiment, the first closing force is greater than the second closing force. In another embodiment, the second closing force is greater than the first closing force. Still further, other embodiments have first and second closing forces that are approximately equal. For example, for a zipper at a 64 mil thickness (1.6 mm) an average closing force for the first closure mechanism 238*a* was found to be 0.15 lb. (0.07 kg.), an average closing force for the second closure element 238*b* was found to be 0.05 lb. (0.02 kg.), and the overall closing force for the combined mechanisms 238*a*, 238*b* was found to be 0.20 lb. (0.09 kg.). When the zipper thickness was increased to 75 mils (1.9 mm) an average closing force for the first closure mechanism 238*a* was found to be 0.18 lb. (0.08 kg.), an average closing force for the second closure element 238*b* was found to be 0.06 lb. (0.03 kg.), and the overall closing force for the combined mechanisms 238*a*, 238*b* was found to be 0.24 lb. (0.11 kg.). Preferably, the overall closing force of the first and second closure mechanisms 238*a*, 238*b* is within the range of about 0.10-0.45 lb. (0.05 to 0.20 kg.), and more preferably in the range of about 0.15 to 0.35 lb. (0.07 to 0.16 kg.), and most preferably in the range of about 0.20 to about 0.30 lb. (0.09 to 0.14 kg.). An overall closing force within the most preferred range allows a dual closure mechanism bag to have a similar overall closing force to those found in conventional single closure mechanism bags. The present embodiment allows for a significantly stronger dual closure mechanism bag while also allowing the user to "feel" as if he were using a single closure mechanism bag with a wide-track feel.

Reclosable thermoplastic storage bags as described herein can be produced by any suitable bag-making process, such as a cast post applied process, a cast integral process, a blown process or any other process known in the art. It should be noted that the extrusion die(s) used to form the closure mechanisms and strip(s) must include a suitable number of profile plates to form such structures. In addition, an air nozzle may be provided in association with each female closure element that blows air into the opening of each C-shaped female profile member to open the member as it is being extruded. In addition, one or more cooling water jets may be provided to cool the male and female closure elements after they are extruded.

Figure 6:
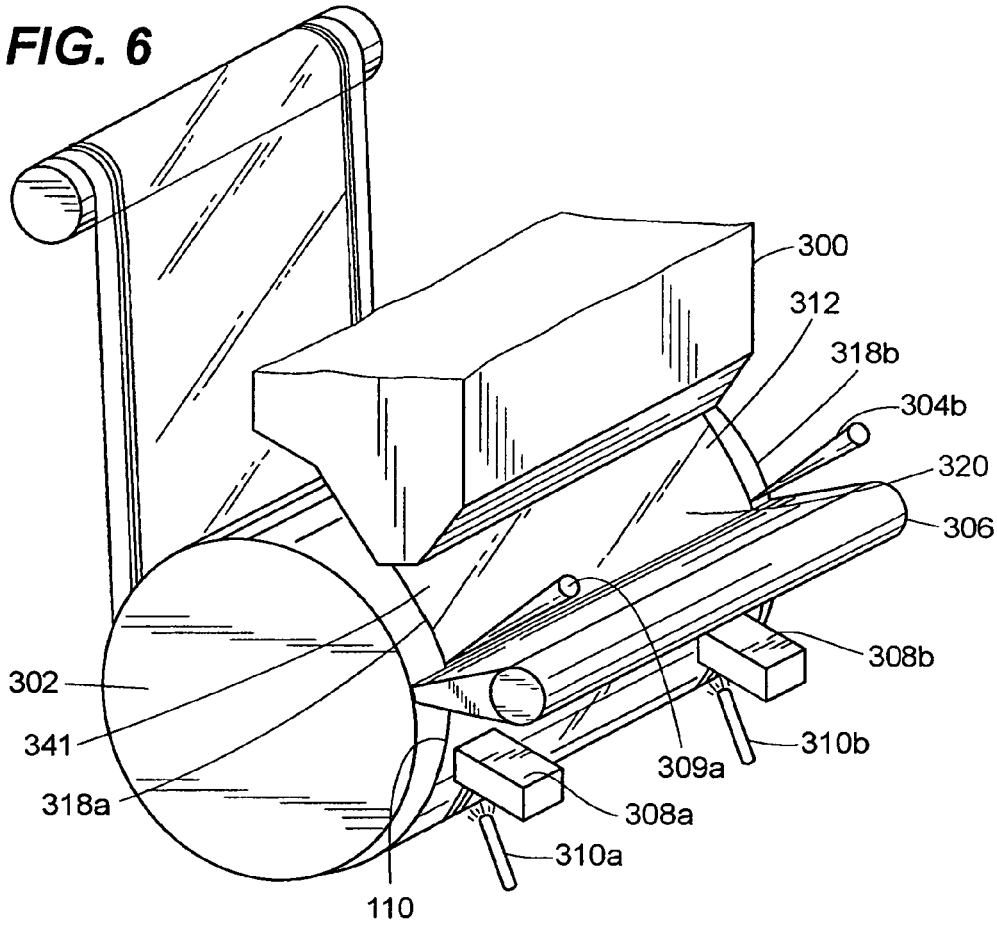
FIG. 6 is an isometric view of an apparatus for producing bags incorporating the present invention.
Figure 7:
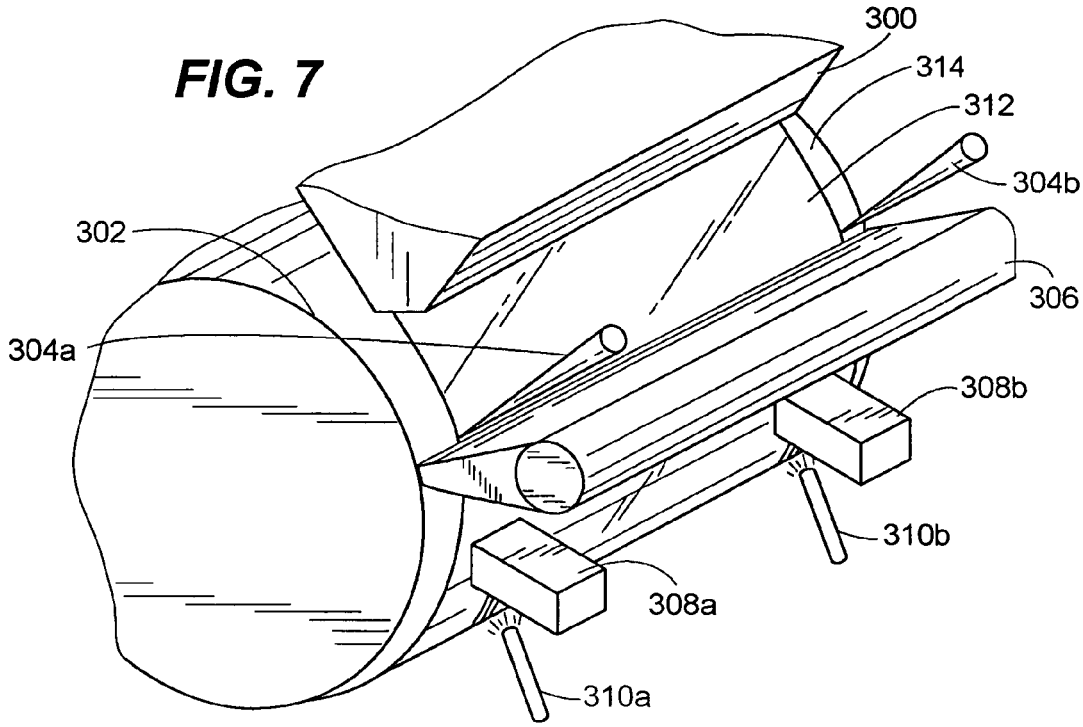
FIG. 7 is an enlarged, fragmentary isometric view of the apparatus of FIG. 6.

If desired, an alternative post applied process can be used to produce any of the bags disclosed herein, such as seen in FIGS. 6 and 7. Referring to such FIGS., the alternative post applied process utilizes an extrusion apparatus including a first extrusion slot die 300, a temperature-controlled driven casting roll 302, edge pinning devices or apparatus 304*a*, 304*b*, an air knife 306, second and third extrusion dies 308*a*, 308*b* (that are diagrammatically shown and which, together with the die 300, form the extrusion apparatus) and blowing apparatus 310*a*, 310*b*. The extrusion die 300 receives molten thermoplastic from an extruder (not shown) and deposits the thermoplastic in sheet form as a web 312 onto the casting roll 302. The extrusion die 300 includes a slot opening (not shown) that forms thickened areas 314, 316 at outside edge portions 318*a*, 318*b* of the resulting web 312 and a relatively thinner portion 320 intermediate the thickened areas 314, 316. The edge portions 318*a*, 318*b* are pinned to the casting roll 302 by the edge pinning devices 304*a*, 304*b*, respectively. The web 312 is then pinned across the entire width thereof (i.e., as a whole) to the casting roll 302 by the air knife 306.

Figure 8:
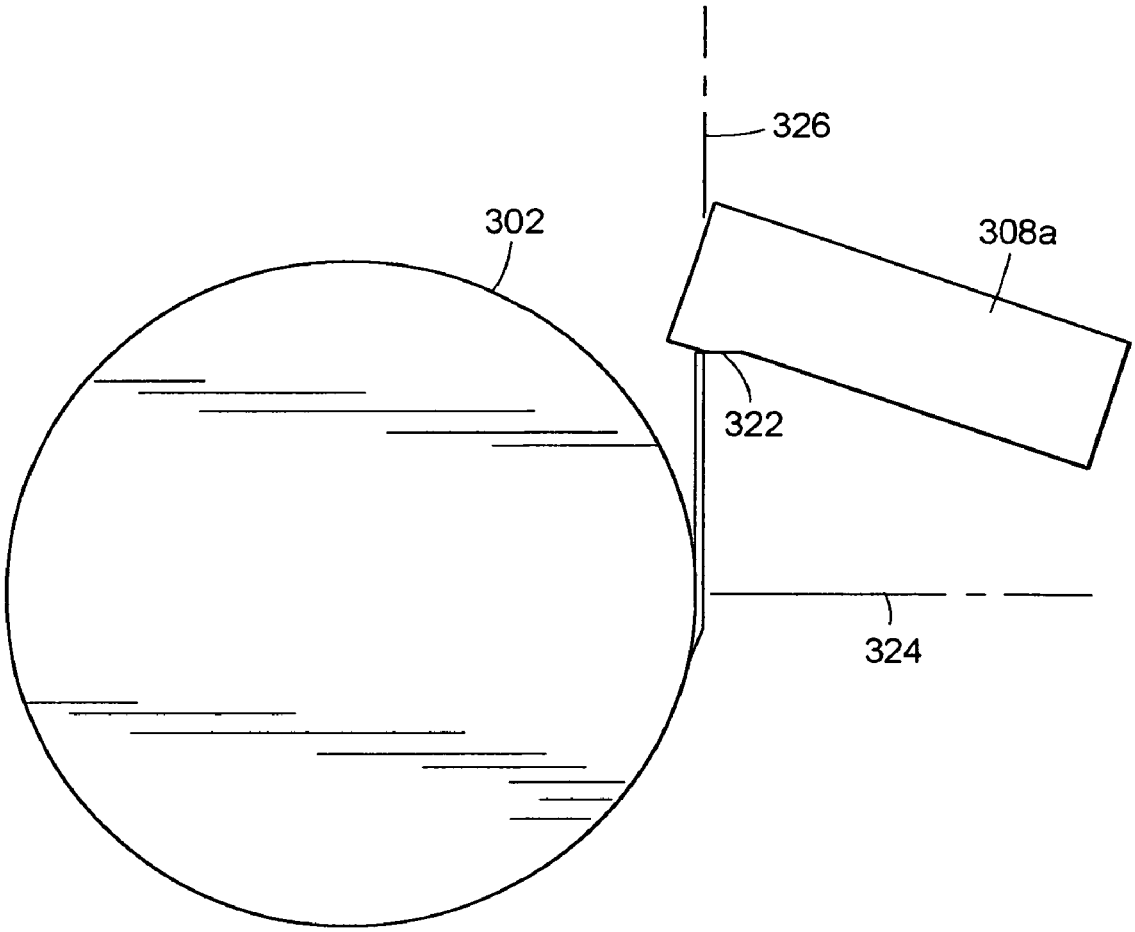
FIG. 8 is an enlarged end elevational view of the apparatus of FIGS. 6 and 7.

After the web 312 is pinned to the casting roll 302, the male and female closure elements 44, 50 or 144, 150 are formed on the web 100. Preferably, the extrusion dies 308*a*, 308*b* receive molten thermoplastic from separate extruders and extrude the male and female closure elements 44, 50 or 144, 150 onto the thickened areas 314, 316. Alternatively, the separate extrusion dies 308*a*, 308*b* may be replaced by a single extrusion die having two outlets at which the male and female closure elements 44, 50 or 144, 150 are simultaneously extruded onto the thickened areas 314, 316. As a still further alternative, each extrusion die 308*a*, 308*b* may be replaced by two or more extrusion dies that individually and separately extrude the closure elements 44, 50 or 144, 150 and the strip(s) 60, 187. In any event, as seen in FIG. 8, the angle of a face 322 of each die 308 is at least initially disposed substantially parallel to a horizontal radial line 324 extending from the center of the casting roll 302. The position of the die 308 (or each die 308*a*, 308*b* individually if separate dies are used) may then be adjusted by moving the die left, right, up, or down (all as seen in FIG. 8) or the die may be tipped (i.e., angularly displaced) to adjust the angle of the die face 322 to obtain desirable results. The closure elements 44, 50 or 144, 150 formed by the die(s) 308 may exit the die(s) 308 at a point coincident with a vertical tangent line 326 (FIG. 8) intersecting the surface of the casting roll 302 on the side of the casting roll 302 where the web 312 is first deposited thereon. Alternatively, the closure elements 44, 50 or 144, 150 formed by the die(s) 308 may exit the die(s) 308 at a point displaced to the right or left (as seen in FIG. 8) of the tangent line 326. If the extrudate exits the die(s) 308 at a point displaced to the right of the line 326, some provision must be made at the initiation of production to attach the extrudate stream to the casting roll 302. Thereafter, production may commence, (provided that the exit of the die(s) 308 is not disposed too far to the right of the tangent line 326) whereupon the melt strength of the extrude stream carries the stream into contact with the roll 302.

Once the molten thermoplastic from the die(s) 308 has been deposited onto the web 312, coolant is applied to the closure elements 44, 50 or 144, 150 by coolant apparatus (not shown) to bring the temperature thereof below the melting point of the thermoplastic material forming the closure elements 44, 50 or 144, 150 as quickly as possible. Preferably, the coolant comprises water or any other suitable cooling fluid and the coolant is applied to the material of the closure elements 44, 50 or 144, 150 only after such material contacts the material of the web 312 so that adhesion thereto is optimized. The web 312 and the closure elements 44, 50 or 144, 150 are maintained in contact with the temperature-controlled casting roll 302 for a period of time as the roll 302 is rotated so that the web 312 and closure elements 44, 50 or 144, 150 are further cooled. The casting roll 302 should be maintained at a temperature below the melting point of the thermoplastic material(s) forming the web 312 and the closure elements 44, 50 or 144, 150, typically about 20-80 degrees C.

Figure 9:
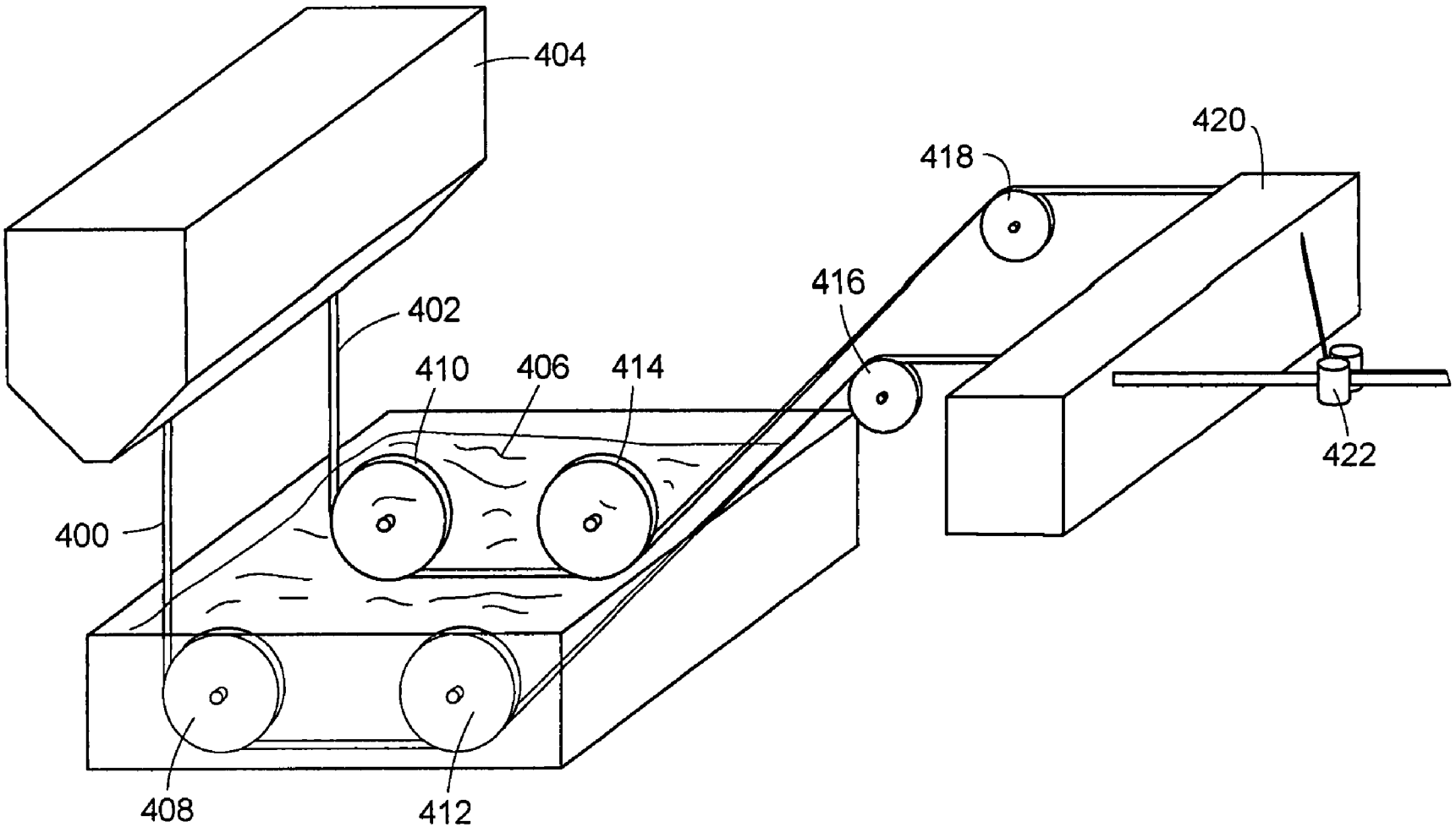
FIG. 9 is a diagrammatic isometric view of an extrusion apparatus for extruding zipper tape incorporating the present invention.

If desired, any of the closure elements and/or strips and/or other associated structures of the above embodiments can be integrally or separately extruded on internal surfaces of flanges to form zipper tape that is subsequently post-applied to film in a bag production process. For example, as seen in FIG. 9, the zipper tape includes a first zipper tape portion 400 and a second zipper tape portion 402 that may be extruded separately by an extrusion die 404 into a water bath 406. If desired, more than one extrusion die may be employed for this purpose. The zipper tape portions 400, 402 extend about pulleys or rollers 408, 410, respectively, in the water bath 306 and may further extend about additional pulleys or rollers 412, 414 and 416, 418 out of the water bath 406. The zipper tape portions 400, 402 may thereafter pass through a dewatering station 420, where the water is removed therefrom, and the portions 400, 402 may be joined together (i.e., occluded) by nip rollers 422. The occluded portions 400, 402 may thereafter be stored on spools or reels or the occluded portions may be directly delivered to an in-line bag manufacturing apparatus, where the portions 400, 402 are laminated or otherwise secured to bag film.

Figure 10:
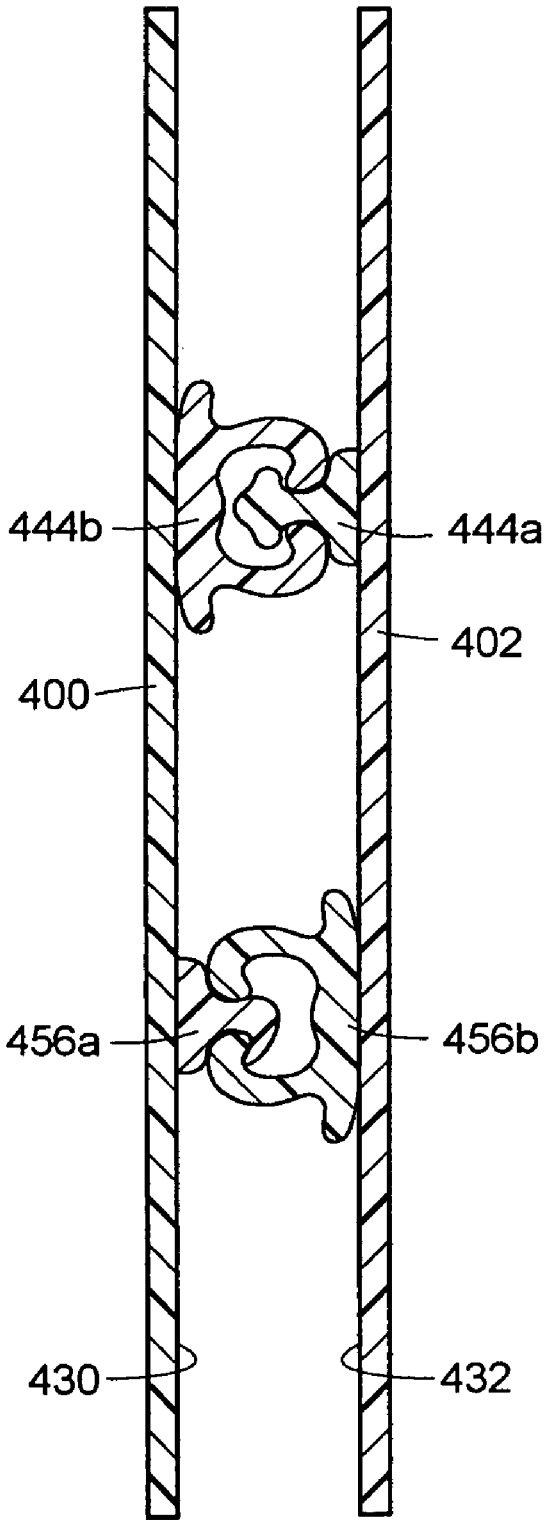
FIG. 10 is an enlarged, elevational view of a zipper tape incorporating the present invention.

Referring to FIG. 10, the first zipper tape portion 400 includes a first inner surface 430 and closure elements 444*b* and 456*a* secured to the first inner surface 430. The second zipper tape portion 402 includes a second inner surface 432 and closure elements 444*a* and 456*b* secured to the second inner surface 432. The closure elements 444*b*, 456*a*, 444*a*, and 456*b* may be similar or identical to the closure elements 244*b*, 256*a*, 244*a*, and 256*b*, respectively, described above. In some embodiments, the zipper tape may be relatively thicker at areas that ultimately form the top of the bag and relatively thinner at areas where the zipper tape is to be joined to the film. Also, gripping strips (not shown) may be formed at the areas that ultimately form the top of the bag.

INDUSTRIAL APPLICABILITY

The pouch described herein advantageously allows for dual closure mechanism pouches to be used that have opening and closing force characteristics similar to those found in single closure mechanism pouches. Thus, closing and opening efficiency is increased and the expenditure of wasted effort by the user is minimized.

Further, the pouch of the present invention can provide aural and tactile feedback of closing and opening of the pouch. Still further, the present pouch can provide a plurality of different closure characteristics and can provide greater security against inadvertent opening of the pouch. The distance between the closure mechanisms can be varied as desired, and the male and female closure elements may be disposed on either wall with or without strip(s) therebetween.

Other structure(s) may be disposed between or outside of the closure mechanisms, as desired.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A reclosable pouch, comprising:

a body portion having first and second bag walls;

a first closure mechanism comprising a first male closure element that is substantially symmetric about a longitudinal centerline and a first female closure element, wherein the first female closure element has first and second spaced legs that are substantially symmetric about a longitudinal centerline, and wherein the first male and first female closure elements are disposed on opposing sides of the first and second bag walls;

a second closure mechanism comprising a second male closure element and a second female closure element that is substantially identical to the first female closure element, wherein the second female closure element has third and fourth spaced legs, and wherein the second male and second female closure elements are disposed on opposing sides of the first and second bag walls; and wherein the first male closure element includes two hook portions extending from an end thereof to engage the legs of the first female closure element and the second male closure element includes only one hook portion extending from an end thereof to engage one of the legs of the second female closure element.

2. The reclosable pouch of claim 1, wherein the first male closure element disengages from the first female closure element with a first external opening force and the second male closure element disengages from the second female closure element with a second external opening force that is less than the first external opening force.

3. The reclosable pouch of claim 1, wherein the first closure mechanism exhibits a first closure characteristic and the second closure mechanism exhibits a second closure characteristic different than the first closure characteristic.

4. The reclosable pouch of claim 3, wherein the first closure characteristic comprises a clicking feel when the pouch is closed.

5. The reclosable pouch of claim 3, wherein the second closure characteristic comprises a first resistance to an external opening force applied to a first side of the second closure mechanism and a second resistance to an internal opening force applied to a second side of the second closure mechanism wherein the second resistance is greater than the first resistance.

6. The reclosable pouch of claim 5, wherein the first side of the second closure mechanism is disposed nearer a top of the pouch than the second side.

7. The reclosable pouch of claim 1, wherein the first closure mechanism is disposed nearer a top of the pouch than the second closure mechanism.

8. The reclosable pouch of claim 1, wherein each of the first and second closure mechanisms includes male and female closure elements and wherein the first female closure element of the first closure mechanism is adjacent the second male closure element of the second closure mechanism on the first bag wall and the first male closure element of the first closure mechanism is adjacent the second female closure element of the second closure mechanism on the second bag wall.

9. The reclosable pouch of claim 1, wherein each of the first and second closure mechanisms includes male and female closure elements and wherein the first female closure element of the first closure mechanism is adjacent the second female closure element of the second closure mechanism on the first bag wall and the first male closure element of the first closure mechanism is adjacent the second male closure element of the second closure mechanism on the second bag wall.

10. The reclosable pouch of claim 1, wherein the first male closure element engages with the first female closure element with a first closing force and the second male closure element engages the second female closure element with a second closing force.

11. The reclosable pouch of claim 1, wherein an overall closing force is in a range of about 0.20 to about 0.30 lb.

12. The reclosable pouch of claim 1, wherein the second male closure element is substantially asymmetric about a longitudinal centerline.

13. A reclosable pouch, comprising:

a body portion having first and second bag walls;

a first closure mechanism comprising a first male closure element that is substantially symmetric about a longitudinal centerline and a first female closure element, wherein the first female closure element has first and second spaced legs that are substantially symmetric about a longitudinal centerline, and wherein the first male and first female closure elements are disposed on opposing sides of the first and second bag walls;

a second closure mechanism comprising a second male closure element and a second female closure element that is substantially symmetrical with the first female closure element, wherein the second female closure element has third and fourth spaced legs, and wherein the second male and second female closure elements are disposed on opposing sides of the first and second bag walls; and wherein the first male closure element includes two hook portions extending from an end thereof to engage the legs of the first female closure element and the second male closure element includes only one hook portion extending from an end thereof to engage one of the legs of the second female closure element, such that the first male closure element disengages from the first female closure element with a first opening force and the second male closure element disengages from the second female closure element with a second opening force that is different than the first opening force.

14. The reclosable pouch of claim 13, wherein a first external opening force of the first male and female closure elements is greater than a second external opening force of the second male and female elements.

15. The reclosable pouch of claim 13, wherein the first closure mechanism exhibits a first closure characteristic and the second closure mechanism exhibits a second closure characteristic different than the first closure characteristic.

16. The reclosable pouch of claim 15, wherein the first closure characteristic comprises a clicking feel when the pouch is closed.

17. The reclosable pouch of claim 15, wherein the second closure characteristic comprises a first resistance to an external opening force applied to a first side of the second closure mechanism and a second resistance to an internal opening force applied to a second side of the second closure mechanism wherein the second resistance is greater than the first resistance.

18. A reclosable pouch, comprising:

a body portion having first and second bag walls;

a first closure mechanism comprising a first male closure element and a first female closure element, wherein the first female closure element has first and second spaced legs, and wherein the first male and first female closure elements are disposed on opposing sides of the first and second bag walls;

a second closure mechanism comprising a second male closure element and a second female closure element, wherein the second female closure element has third and fourth spaced legs, and wherein the second male and second female closure elements are disposed on opposing sides of the first and second bag walls;

wherein the first male closure element includes two hook portions extending from an end thereof to engage the legs of the first female closure element and the second male closure element includes only one hook portion extending from an end thereof to engage one of the legs of the second female closure element, such that the first male closure element engages with the first female closure element with a first closing force and the second male closure element engages with the second female closure element with a second closing force that is different than the first closing force; and wherein the first closing force of the first male and female closure elements is less than the second closing force of the second male and female elements.

19. A zipper tape, comprising:

a first zipper tape portion and a second zipper tape portion, wherein the first zipper tape portion includes a first inner surface and the second zipper tape portion includes a second inner surface;

a first closure mechanism comprising a first male closure element that is substantially symmetric about a longitudinal centerline and a first female closure element, wherein the first female closure element has first and second spaced legs that are substantially symmetric about a longitudinal centerline, and wherein the first male and first female closure elements are disposed on opposing sides of the first and second inner surfaces;

a second closure mechanism comprising a second male closure element and a second female closure element that is substantially identical to the first female closure element, wherein the second female closure element has third and fourth spaced legs, and wherein the second male and second female closure elements are disposed on opposing sides of the first and second inner surfaces; and wherein the first male closure element includes two hook portions extending from an end thereof to engage the legs of the first female closure element and the second male closure element includes only one hook portion extending from an end thereof to engage one of the legs of the second female closure element.

20. The zipper tape of claim 19, wherein each of the first and second closure mechanisms includes male and female closure elements and wherein the first female closure element of the first closure mechanism is adjacent the second male closure element of the second closure mechanism on the first inner surface and the first male closure element of the first closure mechanism is adjacent the second female closure element of the second closure mechanism on the second inner surface.

21. The zipper tape of claim 19, wherein the second male closure element is substantially asymmetric about a longitudinal centerline.

22. The reclosable pouch of claim 18, wherein the first closure mechanism is disposed nearer the top of the pouch than the second side.

* * * * *